US012420326B2

(12) United States Patent
Hancock et al.

(10) Patent No.: US 12,420,326 B2
(45) Date of Patent: Sep. 23, 2025

(54) PUNCH AND DIE ASSEMBLY

(71) Applicant: Rockhouse International Pty Ltd, Molendinar (AU)

(72) Inventors: David Hancock, Oxenford (AU); Douglas Arthur McDonald, Oxenford (AU)

(73) Assignee: Rockhouse International Pty Ltd, Molendinar (AU)

( * ) Notice: Subject to any disclaimer, the term of this patent is extended or adjusted under 35 U.S.C. 154(b) by 604 days.

(21) Appl. No.: 17/631,104

(22) PCT Filed: Jul. 30, 2020

(86) PCT No.: PCT/AU2020/000075
§ 371 (c)(1),
(2) Date: Jan. 28, 2022

(87) PCT Pub. No.: WO2021/016651
PCT Pub. Date: Feb. 4, 2021

(65) Prior Publication Data

US 2022/0274152 A1 Sep. 1, 2022

(30) Foreign Application Priority Data

Jul. 30, 2019 (AU) ..... 2019902705

(51) Int. Cl.
*B21D 19/08* (2006.01)
*B21D 28/14* (2006.01)
(Continued)

(52) U.S. Cl.
CPC ..... *B21D 28/243* (2013.01); *B21D 19/088* (2013.01); *B21D 28/14* (2013.01); *B21D 28/26* (2013.01)

(58) Field of Classification Search
CPC ..... B21D 28/26; B21D 28/14; B21D 19/088; B21D 35/001; B26F 1/14
See application file for complete search history.

(56) References Cited

U.S. PATENT DOCUMENTS 1,861,648 A * 6/1932 Vehko ..... B21D 37/10 72/359
2,350,004 A 5/1944 Whistler et al.
(Continued)

FOREIGN PATENT DOCUMENTS

CN 209077606 U * 7/2019
DE 102011117066 A1 * 5/2013 ..... B21D 19/088

OTHER PUBLICATIONS

Translation of CN-209077606 (Year: 2019).*
(Continued)

*Primary Examiner* — Bobby Yeonjin Kim
(74) *Attorney, Agent, or Firm* — Fox Rothschild LLP

(57) ABSTRACT

A punch and die assembly for a forming assembly for forming flared openings in commercial forming steel sheeting, includes a punch. The punch has a punching element having a base portion and a working portion that extends from a face of the base portion, the working portion defining a working edge with more than two substantially evenly spaced peaks and troughs for forming an opening in the steel sheeting during a working stroke. A flaring element is mountable on the base portion of the punching element, a side of the flaring element defining an arcuate flaring surface that tapers inwardly in the direction of the working stroke. A die supports the steel sheeting, the die having a die opening with a flared die face for facing the flaring surface of the flaring element such that the opening in the steel sheeting is flared by the flaring surface of the flaring element and the die face in the working stroke.

13 Claims, 24 Drawing Sheets

(51) Int. Cl.
*B21D 28/24* (2006.01)
*B21D 28/26* (2006.01)

(56) References Cited

U.S. PATENT DOCUMENTS

| | | | |
|---|---|---|---|
| 5,052,207 | A | 10/1991 | Porucznik |
| 5,727,436 | A | 3/1998 | Swedberg et al. |
| 2013/0145915 | A1 | 6/2013 | Nordlin et al. |

OTHER PUBLICATIONS

Translation of DE-102011117066 (Year: 2013).*
https://www.eastwood.com/eastwood-punch-and-flaring-dies.html. Accessed Feb. 2, 2022.
https://www.youtube.com/watch?v=jGLMNVQIJBk. Accessed Feb. 2, 2022.

* cited by examiner

PUNCH AND DIE ASSEMBLY

FIELD OF THE INVENTION

This invention relates to a forming assembly, a punch and die assembly of the forming assembly and to a method of producing a flared opening in a workpiece.

BACKGROUND OF THE INVENTION

The forming or punching of openings in steel workpieces is a common operation. The punching force or pressure required is dependent on, inter alia, the material of the workpiece and the thickness of the workpiece. For relatively small openings, such as those formed for fasteners such as bolts and screws in commercial forming steel or mild steel having a thickness of between about 1 mm and 3 mm, the required punching force is sufficiently low so as not to require overly large and powerful equipment. However, forming steel sheeting can require larger openings, up to 75 to 100 times the material thickness (MT). Such openings can be used for conduits and other services, where the steel sheeting is used in buildings, for example. Such openings also serve to reduce the weight of the steel plate, with flared perimeter portions of the openings serving to maintain or improve the structural integrity of the forming steel.

In conventional punching operations, considering the material thickness range involved, the radial clearance between the side of the punch and the support side of the die is 5% to 8% of the material thickness to be punched, and, in general, the punching load for mild steel is in the order of 30 tons per square inch of material sheared by the punch, for example, a material thickness times the length of the cut. For the desired hole, this would equate to approximately 27 tons of punch force per hole. For example, there may be four holes in one component, all of which need to be flared and which are relatively close to each other. Typically, such work would be done in a heavy, stationary factory-based machine using multi-station tooling to first make the holes and then, in a further station, to form the flares.

With the conventional equipment referred to above and with the holes or apertures relatively close to each other, a significantly robust, and thus large, clamping or stripper plate is required in order to avoid forming of the web during the separate punching and flaring operations. The multi-station nature of the equipment further amplifies the weight and size of the required machinery.

The pressures associated with the required punching force and the addition of a further station to achieve a flare in the opening requires that the equipment has suitably robust dies to bear the necessary reactive pressure. As a result, the equipment is necessarily large and heavy and, in particular, not capable of being towed on a trailer with a conventional vehicle.

In International Application Number PCT/AU2015/050381 ("PCT '381), the entire contents of which are hereby incorporated by reference, there is described steel beams that include multiple apertures with flared rims. These form part of a framing system for building structures. PCT '381 also describes a mobile machine that can be towed by a conventional vehicle. The machine is capable of forming beams of commercial forming steel with a thickness of between 1 mm and 3 mm with multiple apertures. An example of such a beam is shown in FIG. 1 of the drawings.

Deference to the design constraints of such a mobile machine demands that the holes and the flares be formed in a single station in a single working stroke. Due to the low power and mass of the mobile machine when compared with the stationary equipment referred to above, the holes and the flares need to be formed against a minimal holding force of a stripper plate. For example, a primary punch load would need to be significantly less than a normal blanking load, using the conventional stationary equipment, of about 27 tons because the nearest support for the material to be punched cannot be as little as 5% to 8% of the material thickness away from the punch. Such an arrangement would not permit the flared rim to formed in the same working stroke as the forming of the aperture.

Such excessive force without close support for the material can result in deformation of material between the apertures, without a correspondingly high load on the surrounding material with a stripper plate or clamp plate, which would need to be large and heavy, further limiting mobility of the machine.

SUMMARY OF THE INVENTION

According to one aspect of the invention, there is provided a punch and die assembly for a forming assembly for forming flared openings in commercial forming steel sheeting, the punch and die assembly comprising:

a punch that includes:

a punching element having a base portion and a working portion that extends from a face of the base portion, the working portion defining a working edge with more than two substantially evenly spaced peaks and troughs for forming an opening in the steel sheeting during their working stroke; and a flaring element mountable on the base portion of the punching element, a side of the flaring element defining an arcuate flaring surface that tapers inwardly in the direction of the working stroke; and a die for supporting the steel sheeting, the die having a die opening with a flared die face for facing the flaring surface of the flaring element such that the aperture in the steel sheeting is flared by the flaring surface of the flaring element and the die face in the working stroke.

The punching element may have eight peaks and eight troughs.

The working portion of the punching element may have a diameter, at a working end, of from 70 to 80 times a material thickness (MT) of the steel sheeting.

The flaring element may have a diameter of from 90 MT to 100 MT of the steel sheeting.

The die face may have a minimum diameter of from 80 MT to 90 MT of the workpiece and a maximum diameter of from 90 MT to 100 MT of the steel sheeting.

The die face may have a maximum diameter of from 10 MT to 20 MT greater than a diameter of the working end of the punching element.

The back angle defined by radial profiles of an outer surface and an inner surface of the working portion may be between 42° and 48°.

The height of the working portion, measured from the face of the base portion, may be between 9 mm and 12 mm.

Each peak 48 may define an axial profile with a curve having an average radius of between 28 mm and 33 mm. Each trough may define an axial profile with a curve having an average radius of between 5 mm and 15 mm.

The flaring element may have a base portion that can be fastened to a punch bolster and a flaring portion that extends from the base portion.

The flaring surface may have an axial profile with a radius of curvature of between 9 mm and 13 mm.

According to a second aspect of the invention, there is provided a forming assembly for forming flared openings in commercial forming steel sheeting, the forming assembly comprising:

at least four colinear punch and die assemblies, each punch and die assembling including:

a punch that includes:

a punching element having a base portion and a working portion that extends from a face of the base portion, the working portion defining a working edge with more than two substantially evenly spaced peaks and troughs for forming an opening in the steel sheeting during a working stroke, and a flaring element mounted on the base portion of the punching element, a side of the flaring element defining an arcuate flaring surface that tapers inwardly in the direction of a working stroke; and a die for supporting the steel sheeting, the die having at least four die openings in operative arrangement with respect to the punching elements, each die opening having a flared die face for facing the flaring surface of the flaring element such that the openings in the steel sheeting are flared by the flaring surfaces of the flaring elements and the die faces in the working stroke.

According to a third aspect of the invention, there is provided a forming assembly for forming flared openings in commercial forming steel sheeting, the forming assembly comprising at least four co-linear punch and die assemblies, each punch and die assembly being the punch and die assembly as described in the first aspect above.

The forming assembly may include four of the punch and die assemblies.

The forming assembly may include two adjacent inner assemblies positioned between two outer assemblies such that, during the working stroke, the outer assemblies impinge on the steel sheeting before the inner assemblies or vice versa.

According to a fourth aspect of the invention, there is provided a method of forming a flared opening in commercial forming steel sheeting using a punch and die assembly, the punch and die assembly including a punch having a punching element having a base portion and a working portion, the working portion defining a working edge with more than two substantially evenly spaced peaks and troughs for forming an opening in the steel sheeting, and a flaring element mountable on the base portion of the punching element, a side of the flaring element defining an arcuate flaring surface that tapers inwardly in the direction of a working stroke, and a die for supporting the steel sheeting, the die having a die opening with a flared die face for facing the flaring surface of the flaring element such that the aperture in the steel sheeting is flared by the flaring element and the die face in the working stroke, the method comprising the steps of:

supporting the steel sheeting on the die below the punch; and operating the punch in the working stroke to form the flared aperture in the steel sheeting.

The invention extends to a steel beam that includes a web that defines flared openings formed in the method described herein.

The invention also extends to a steel beam that includes a web that defines flared openings formed using the punch and die assembly described herein.

According to a fifth aspect of the invention, there is provided a punch for a punch and die assembly for a forming assembly for forming flared openings in commercial forming steel sheeting, the punch comprising:

a punching element having a base portion and a working portion that extends from a face of the base portion, the working portion defining a working edge with more than two substantially evenly spaced peaks and troughs for forming an opening in the steel sheeting during a working stroke; and a flaring element mountable on the base portion of the punching element, a side of the flaring element defining an arcuate flaring surface that tapers inwardly in the direction of the working stroke, the flaring surface suitable for facing a flared die face of a die such that the opening in the steel sheeting is flared by the flaring surface of the flaring element and the die face in the working stroke.

DETAILED DESCRIPTION OF THE INVENTION

Figure 1B:
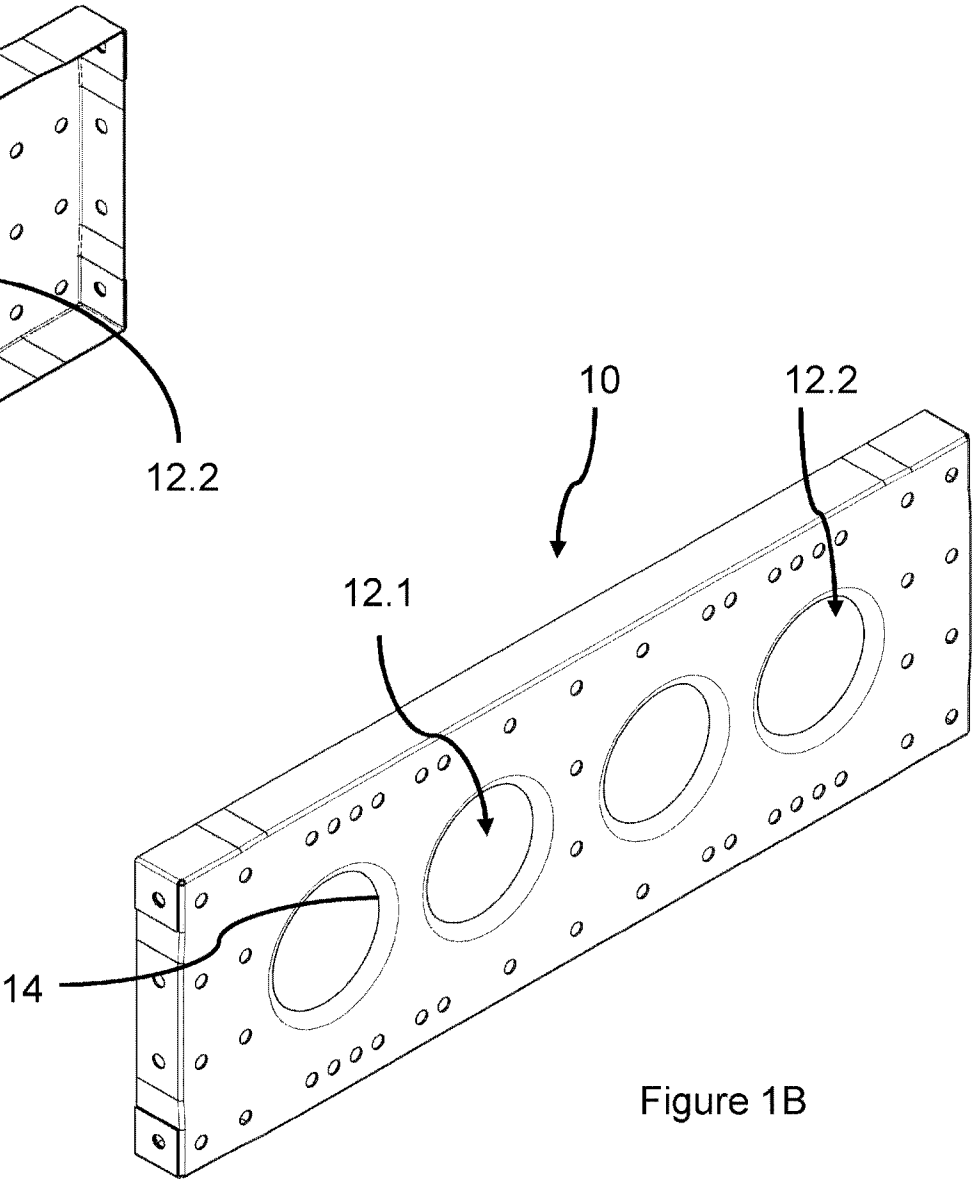
FIG. 1B shows a front perspective view of the component of FIG. 1A.
Figure 1A:
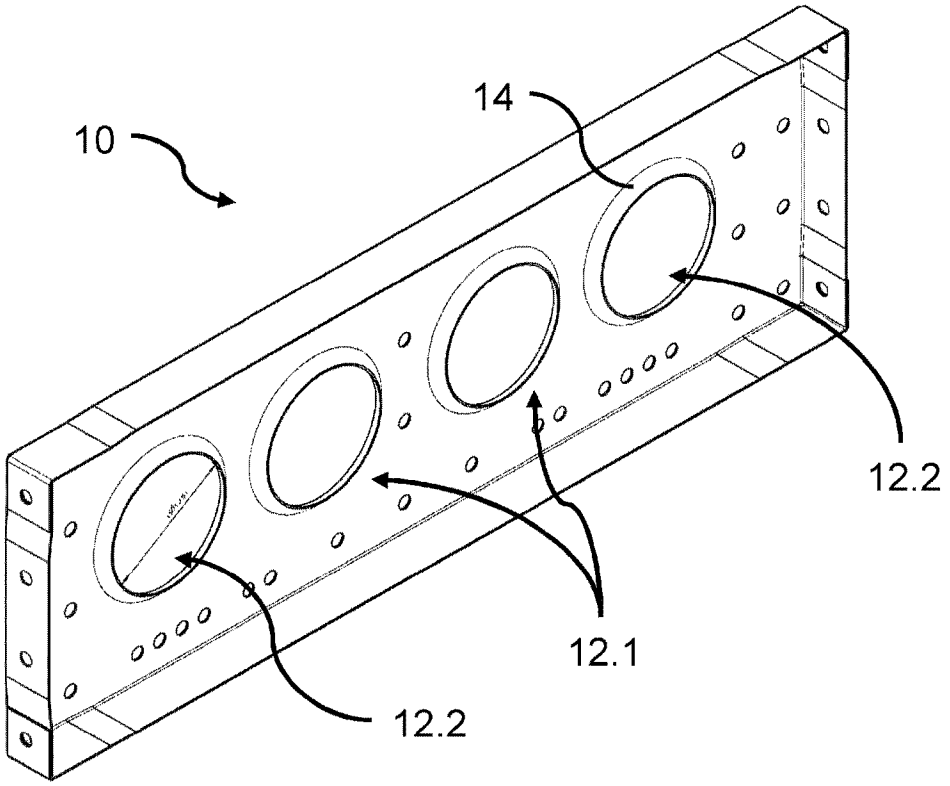
FIG. 1A shows a rear perspective view of a building component made using one embodiment of a forming assembly, in accordance with the invention, having a series of an embodiment of a punch and die assembly, in accordance with the invention.

As set out in the background, PCT '381 describes steel beams such as a beam 10 shown in FIGS. 1A and 1B. The beam 10 includes multiple circular apertures 12 in a web 13 of the beam 10. The apertures 12 serve to provide for service conduits and other ancillary building equipment. The apertures 12 have flared rims 14 for maintaining or improving a structural integrity of the beam 10 so as to minimise or remove any weaknesses resulting from a removal of the material to form the apertures 12. The beam 10 includes four apertures in the form of two inner apertures 12.1 interposed between two outer apertures 12.2 It is to be appreciated that the punch and die assembly of the invention is not limited to use in the formation of the apertures 12. The beam 10 is simply described as an example of a beam having flared apertures that can be formed using the punch and die assembly of the invention.

In general, the material of the beam 10 can be of commercial forming steel sheeting or mild steel sheeting with a thickness of between 1 mm and 2 mm, or thicker, depending on the application. The steel is hot-dipped and zinc-coated and has a thickness of 1.6 mm with a base metal thickness of 1.55 mm. The steel can be that provided by Bluescope Steel (trade mark) and trades under the name Galvabond (trade mark), or the equivalent. Such steels are conventionally used for fabricating electrical cabinets, non-exposure automotive panels, washing machines, doorframes and switchboards.

Each aperture 12 can be of a size that represents between about 15% and 20% of the web 13, prior to the apertures 12 being formed. The apertures 12 can each have a diameter of between about 110 mm and 130 mm, for example, 120 mm. A distance between centres of the inner apertures 12.1 is between about 175 mm and 200 mm and a distance between each outer aperture 12.2 and the adjacent inner aperture 12.1 is between about 175 mm and 200 mm.

As foreshadowed in the Background, in the industry at present, such apertures would need to be formed by machines that include multiple, sequential stations and associated tooling. The material would initially undergo a punching operation using a first tool at a first station to form an aperture. Subsequently, a flaring operation would be carried out using a second tool at a second station for forming the associated flared rim. The foregoing operations are generally performed in factories which accommodate the required complex multi-function tools and associated multi-station equipment which are large, heavy high-speed machines grounded in concrete bases for stability and accuracy. The products of such operations then need to be transported to locations at which they are used for construction, for example.

Such machines and associated tooling are not desirable for fabricating the beam 10 or similar building components on site. For example, in PCT '381, there is described machinery that can be towed to a building construction site to permit beams and other components to be fabricated at the site. PCT '381 describes machinery for creating the aperture 12 and the flared rim 14 in a single operation. Such machinery is necessarily low-power machinery when compared with conventional machinery used for such processes. Furthermore, such machinery needs to be significantly smaller than conventional machinery so as to facilitate towing of the machinery to a building construction site, for example. In addition to the difficulties associated with achieving suitably dimensioned apertures with flared rims in a single stroke, with such machinery, this also poses at least the challenge of maintaining the integrity of a workpiece between the adjacent apertures 12 and around each aperture 12, with that machinery. With conventional machinery, it is possible to generate the required pressure to achieve punching with conventional die clearances of between 5% and 8% of the material thickness, as set out in the Background. Such machinery also has the capacity to carry out a further flaring operation as a separate stage to the punching operation. Furthermore, with conventional machinery, there is enough weight and space capacity to allow for a multistage operation. Such weight and space capacity are not available with machinery that needs to be capable of being towed, for example, on a trailer.

For example, to punch an aperture without a flared rim in the steel referred to above, the diameter of the die opening would only be typically around 10% to 20% of the material thickness larger than the punch diameter. This provides support for the material to be punched against the force of the punch. The punching force for a 120 mm diameter aperture in the material described above would be in the order of 26 to 28 tons with such a clearance using a conventional punching or blanking tool.

To form a flared rim around the aperture in a single stage operation, a required workpiece aperture should be smaller than the diameter of a die opening or hole; more so than would be required without creation of the flared rim. This leaves an annulus of unsupported material that will form the flared rim during a working stroke of a punch assembly. In various embodiments, a working end of a punch, in accordance with the invention, has a diameter of between 70 and 80 times a material thickness (MT), for example 75 MT, of a workpiece in the form of the steel sheeting described herein, the die opening is 80 MT to 90 MT in diameter, for example, 80 MT, and the maximum diameter of a flared die face of the die opening is 90 MT to 100 MT, for example, 92.5 MT in diameter. Thus, at the maximum diameter of the die face, a die clearance can be between 10 MT and 15 MT.

Throughout the specification, including the claims, the letters "MT" refer to "material thickness", which is the thickness of the commercial forming steel described above and herein. It will readily be appreciated by a person of ordinary skill in the art that the ranges of dimensions given herein can be calculated, in millimetres, by using the values of MT provided herein. It is to be understood that the letters MT are a well-known acronym, in the art, for "material thickness". As such, a person of ordinary skill in the art will readily understand what is meant by the use of such letters when describing various dimensions of components in relation to other components.

It was recognised that the punch needs to work against a diaphragm strength of a circular region of commercial forming steel, of the type described above, with a diameter of 90 MT to 100 MT, for example 92.5 MT. Experimentation led to the understanding that the punching element of an assembly had to penetrate the material as lightly as possible, then shear the material and progress to form the flare. Furthermore, it was imperative to the inventor that the slug would drop away cleanly and freely on every working stroke or cycle.

In this specification, the various punching elements are of tool steel, capable of performing as a punch in a punching operation. The tool steel is D2 steel. Such steel has a hardness of between 55-62 HRC. In this example, the steel has a hardness of 56 HRC.

Figure 2:
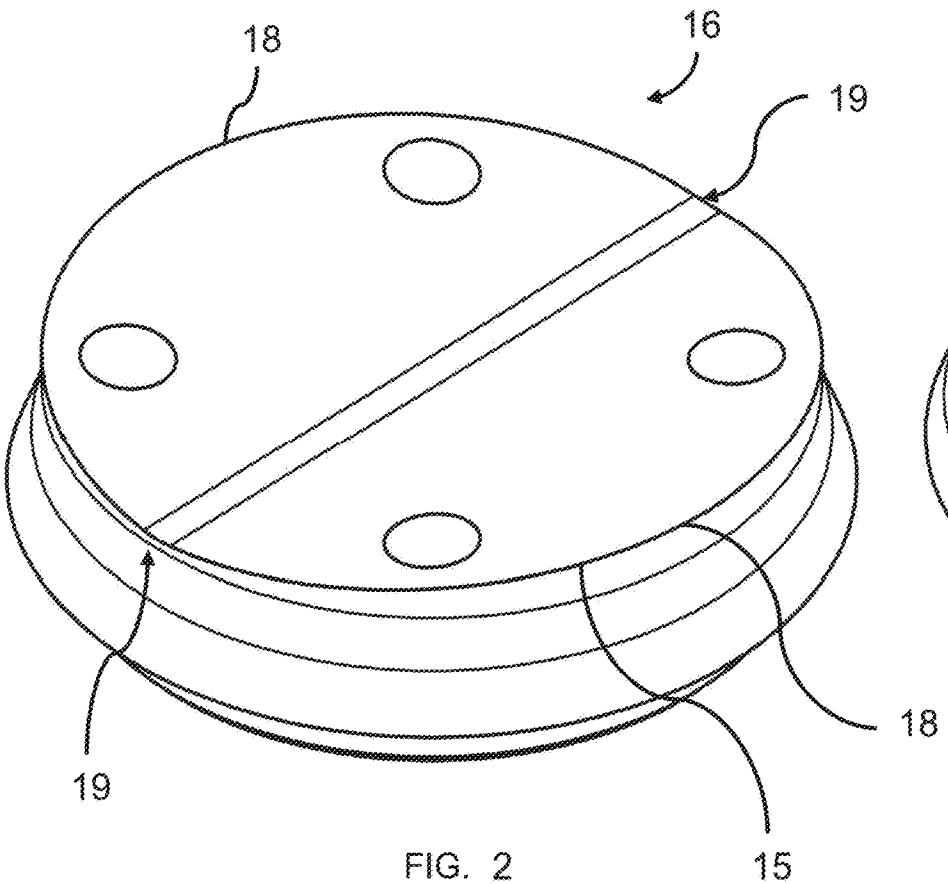
FIG. 2 shows a two-peaked punching element tested during development of the various embodiments of the invention described herein.

FIG. 2 shows a punching element 16, which was investigated during the development of the invention and was found not to be effective and so does not fall within the scope of the invention as defined herein. The description of the punching element 16 is to provide some background to the development of the invention defined herein. The punching element 16 has a working edge 15 with two peaks 18 and corresponding troughs 19 for effecting an initial penetration of the workpiece. This punching element 16 was found to be not optimal for steel of the type described above. The punching element 16 was tested on the steel referred to above.

The punching force required for the punching element 16 was impractically high for the steel described above and the slug failed to detach cleanly from the workpiece. For such a punching element, with two peaks, to be used effectively, it may be necessary for the required height of the peaks to be impractical for use in the machinery described in 'POT '381 or for use in the forming assembly described herein. Such impracticality may extend to a machine that carries out a punching and flare forming operation in a single working stroke, and which is mobile. Amongst other reasons, the required height would be as a result of the need to provide a suitable "back angle" to provide the working edge 15 with the required cutting or shearing capacity. For example, a 45° back angle, referred to below, would result in an excessive height of the peaks 18. The concept of "back angle" is described in further detail below. In particular, the back angle of the edge 15 was too large for a punching element for use with the machinery or apparatus referred to above. Furthermore, a suitable differential between an extent of curvature of an axial profile of the peaks 18 and an extent of curvature of an axial profile of the troughs 19 is not practically achievable with the punching element 16 such that the punching element 16 would be able to be used with the machinery referred to above.

Furthermore, with the punching element 16, it was deduced that the slug failed to detach cleanly because the region forming the slug was not able to be retained from differential shearing at diametrically opposite locations aligned with the opposed troughs 16 with just two peaks and associated troughs.

In this specification, the term "axial profile" is intended to describe a two-dimensional profile defined by points having positions that vary axially along a surface having an axis of rotation that extends in a stroke direction of the punching element.

Figure 3:
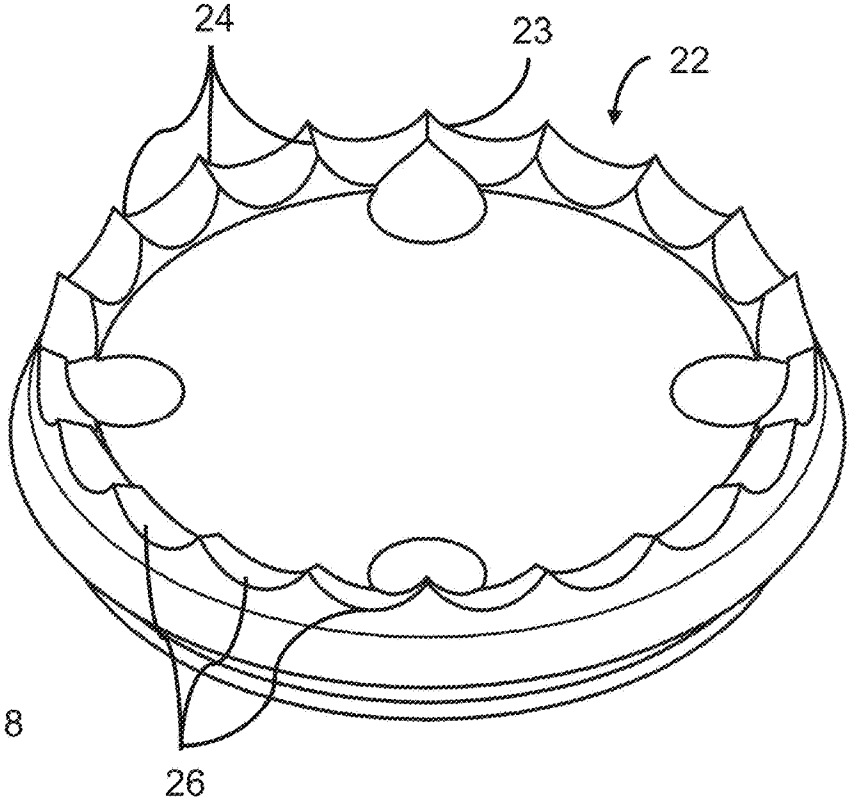
FIG. 3 shows a twenty-peaked punching element tested during the development of the various embodiments of the invention described herein.

FIG. 3 shows a further trial punching element 22, which includes a working edge 23 having twenty peaks 24 for penetration of the workpiece, and corresponding troughs 26 for shearing the workpiece. For the steel referred to above, the slug also failed to detach cleanly and consistently enough to the satisfaction of the inventor. This was likely due to a failure of the slug to break off from the workpiece consistently at an inflection point of each trough, with the required punch force creating deformation of the workpiece, allowing the punching element 22 to pass through the workpiece without full detachment of the slug.

Figure 5:
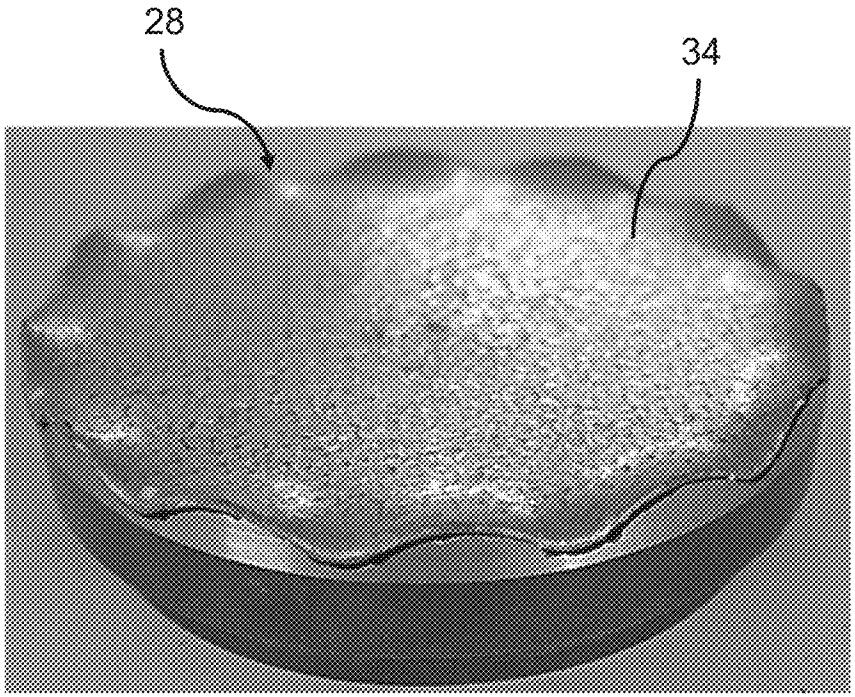
FIG. 5 shows the punching element of FIG. 4 including a slug ejected from the punch and die assembly using the punching element.
Figure 4:
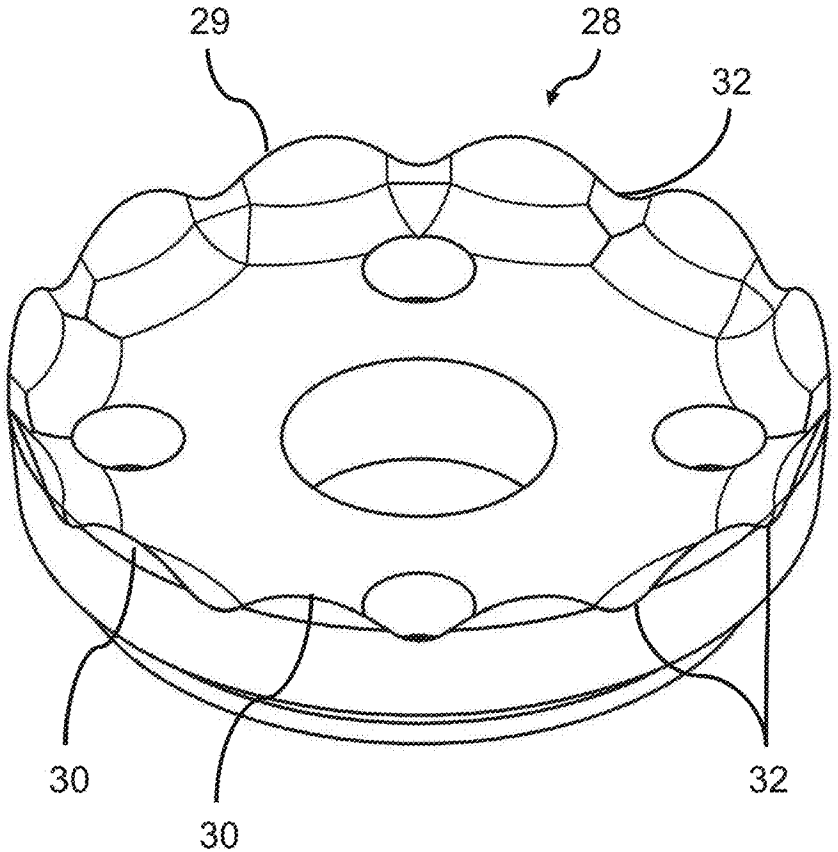
FIG. 4 shows a twelve-peaked punching element tested during the development of the various embodiments of the invention described herein.

FIG. 4 shows a further trial punching element 28, which includes a working edge 29 having twelve peaks 30 for penetration of the workpiece, and corresponding troughs 32 for shearing the workpiece. FIG. 5 shows the punching element 28 including a corresponding slug 34, which is punched from the workpiece by a punch and die assembly incorporating the punching element 28. With the steel referred to above, this punching element 28 provided a suitable detachment of the slug from the workpiece. However, the punching element 28 was damaged during operation. More particularly, a cutting edge of the punching element 28 was chipped and experienced a decrease in cutting efficacy. It is believed that the back angle of the working edge 29 was too low to provide enough structural integrity to avoid damage to the edge 29.

It is to be noted that the punching elements shown in FIGS. 2 to 5 can be in accordance with an aspect of the invention, depending on the type of steel of the workpiece, the thickness of that steel and the diameter of the opening to be punched. Thus, a further parameter that may result in the punching elements of FIGS. 2 to 5 being in accordance with an aspect of the invention is the diameter of the apertures being formed. The purpose of the above paragraphs is to describe a testing process for achieving an embodiment of a punching element suitable for the steel referred to above with the aperture range of 110 mm to 130 mm. Also, with thinner steel sheeting the trial punching element 28 may not suffer damage.

Figure 6:
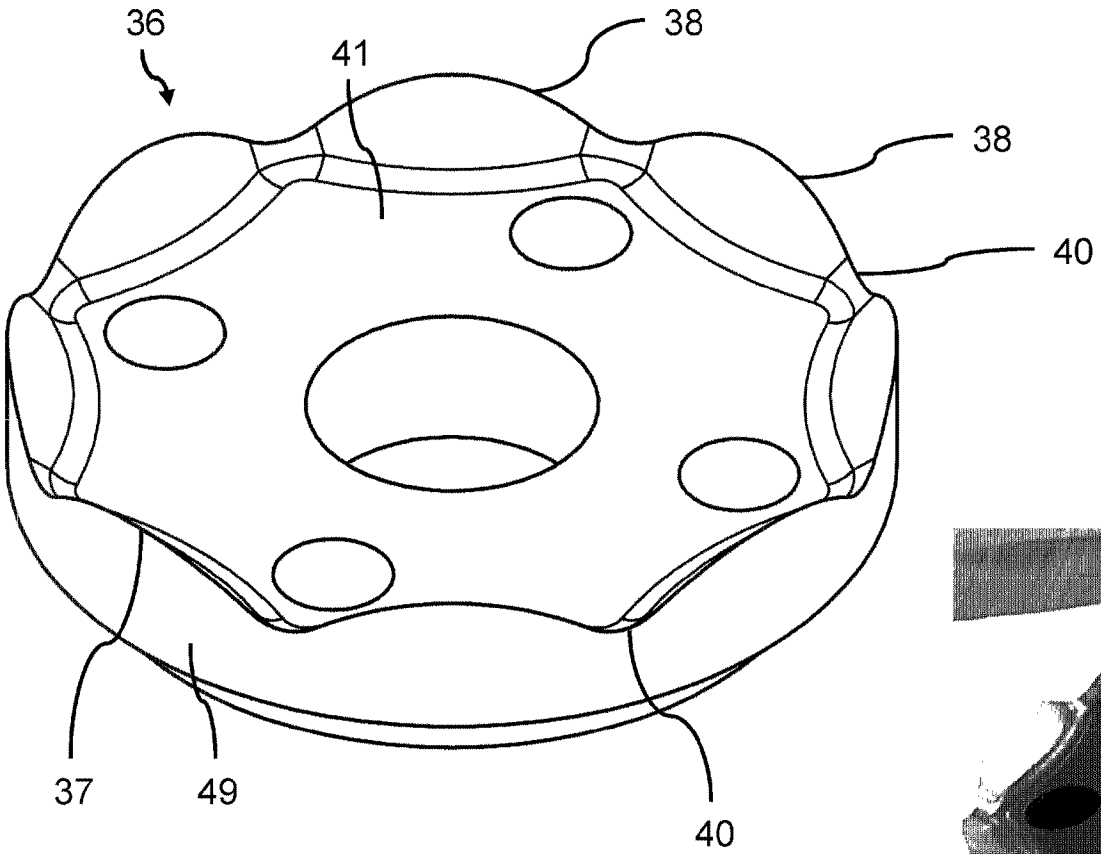
FIG. 6 shows an eight-peaked punching element according to an aspect of the invention.
Figure 9:
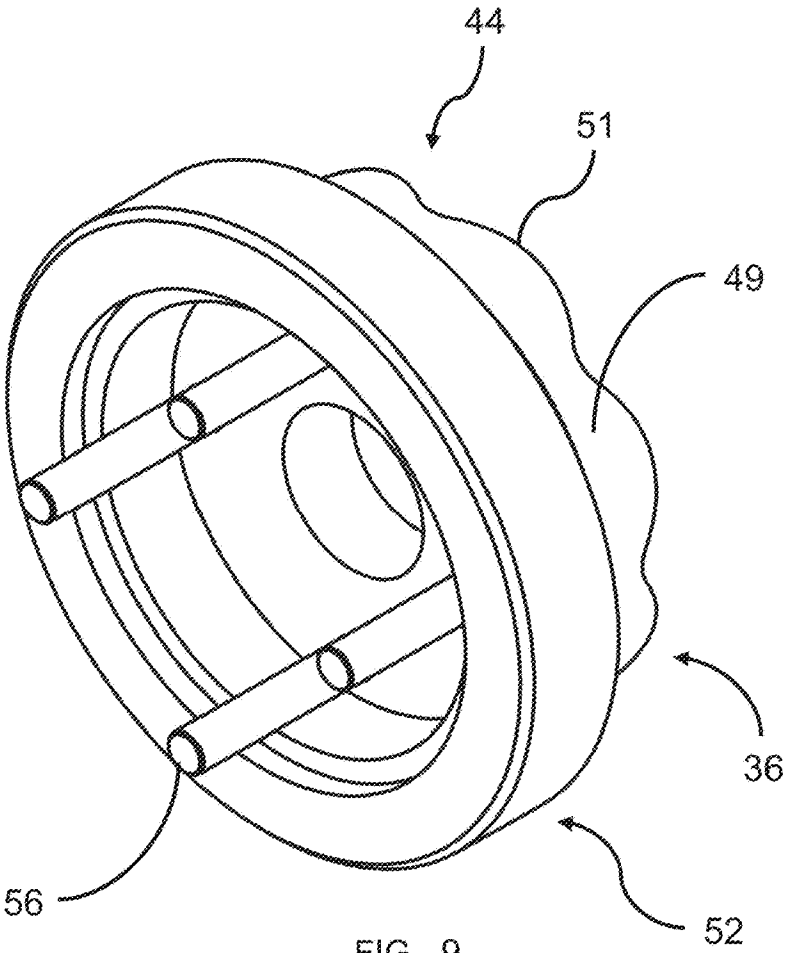
FIG. 9 shows a top perspective view of the punch of FIG. 8.
Figure 8:
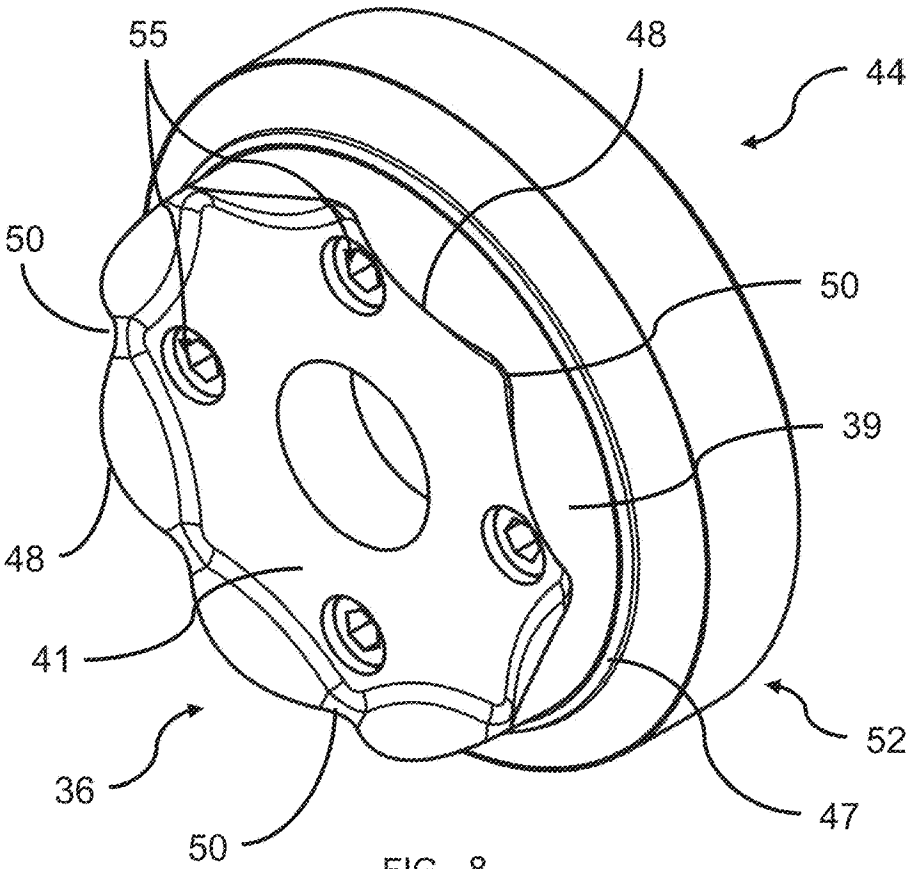
FIG. 8 shows a bottom perspective view of a punch of one embodiment of a punch and die assembly, according to an aspect of the invention.
Figure 10:
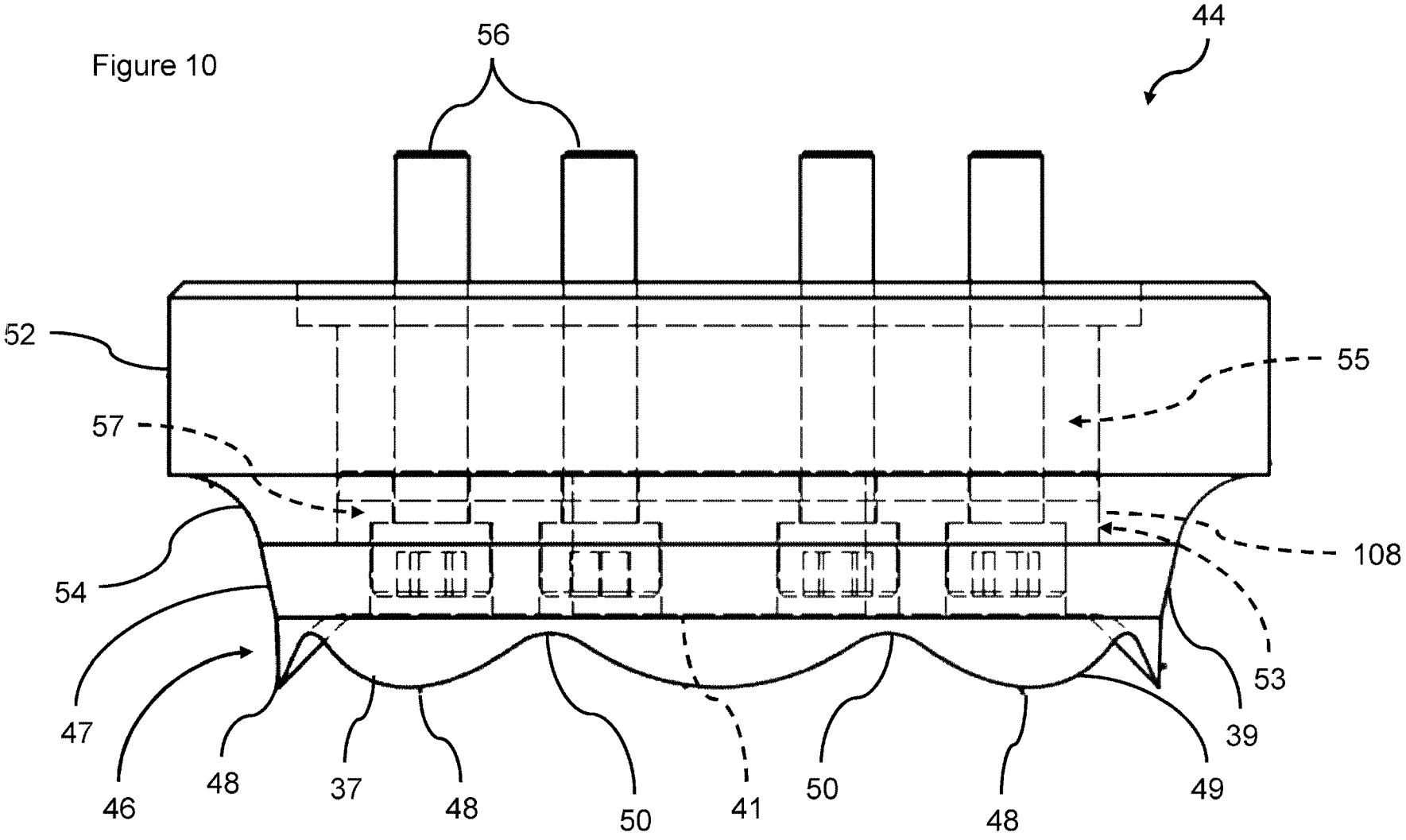
FIG. 10 shows a side view of the punch of FIG. 8.
Figure 11:
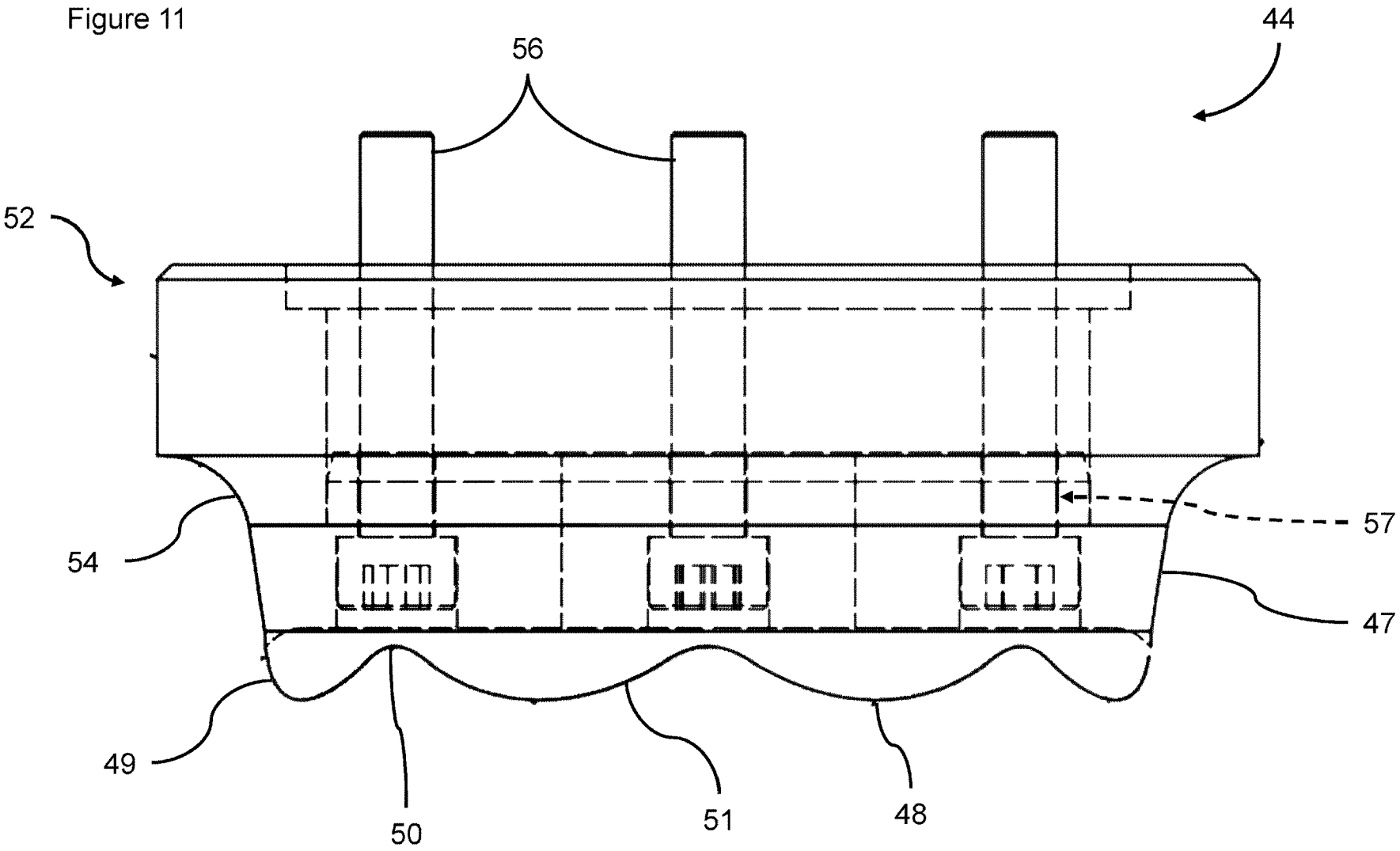
FIG. 11 shows a side view of the punch of FIG. 10, rotated through 22.5 degrees relative to FIG. 10.

FIG. 6 shows a punching element 36 according to an aspect of the invention, which includes a working edge 37 having eight peaks 38 for penetration of the workpiece, and eight corresponding troughs 40 for cutting or shearing the workpiece in the form of steel sheeting for a steel beam, such as the beam 10.

Figure 7:
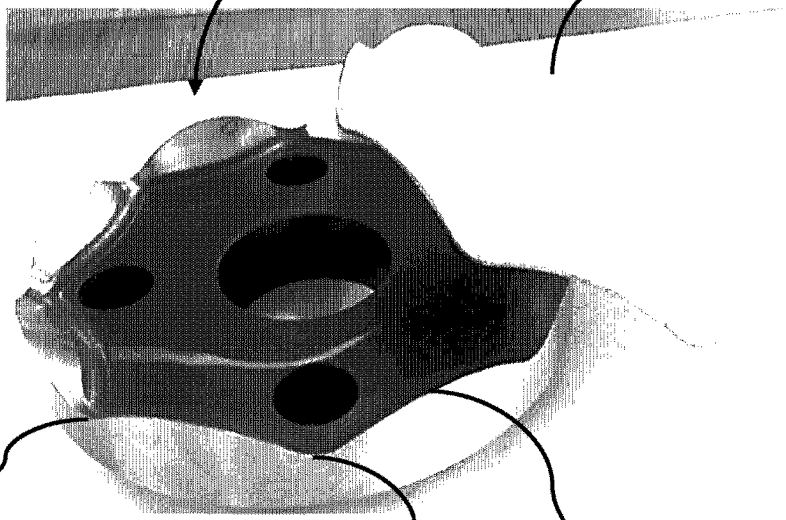
FIG. 7 shows the punching element of FIG. 6 including a corresponding slug ejected from the punch and die assembly using the punching element.

FIG. 7 shows the punching element 36 including a corresponding slug 42, which is punched from the workpiece by a punch and die assembly according to an aspect of the invention. In use, in one example of a forming assembly according to an aspect of the invention, the peaks 38 penetrate the material to be punched. In order to form the round aperture 12,1, 12.2 as required in the beam 10 (FIGS. 1 and 2), the corresponding troughs 40 shear the material and thereby form a substantially seamless working edge to free the slug 42. This configuration of a punching element of the invention enables the foregoing substantially without deformation of the material surrounding the aperture 12.1, 12.2, and facilitates a substantially clean breakaway of the slug 42. The process of forming a flared rim is described in further detail below. It is understood that the material to form the slug 42 effectively nests in the peaks and troughs 38, 40, thereby inhibiting relative movement of the material and the punching element 36 and the resultant differential separation of the material to form a partial breakaway of the slug 42.

It will be appreciated that a larger opening could necessarily require a larger number of peaks and troughs to retain the relative dimensions of the peaks and troughs of the punching element 36. In other words, with a larger diameter punching element, more peaks and troughs will be required to retain the dimensions of the respective peaks and troughs, described herein. It will readily be appreciated that the number of peaks and troughs can be calculated based on the relationship between the number of peaks and troughs of the punching element 36 and the diameter of the aperture to be formed.

Referring to FIGS. 8 to 11, a punch 44, according to an aspect of the invention, includes the punching element 36 for shearing a workpiece to form an aperture in the workpiece. The punching element 36 has a base portion 47 and a working portion 49 that extends from a face 41 of the base portion 47. The working portion 49 defines the working edge 37 having eight evenly spaced peaks 48 and eight valleys or troughs 50, which are substantially identical to the peaks 38 and troughs 40 described with reference to FIG. 6. The working edge 37 extends from a perimeter of the base portion 47.

A flaring element 52 can be mounted on the base portion 47 of the punching element 36, a side of the flaring element 52 defining an arcuate flaring surface 54 that tapers inwardly in the direction of a working stroke and is in register with the working portion 49 to define a continuous transition from the flaring surface 54 to an external surface 39 of the working portion 49. To that end, the base portion 47 is stepped to define a shoulder 53 so that a stub 108 of the base portion 47 can nest in a passage 55 defined by the flaring element 52 (FIG. 10) to locate the punching element 36 relative to the flaring element 52.

Instead of the continuous transition from the flaring surface 54 to the external surface 39, the flaring surface 54 can have a radial profile that turns through up to 90°. As a result, in an embodiment, there can be a stepped transition from the flaring surface 54 to the external surface 39.

In this specification, the term "radial profile" is intended to describe a two-dimensional profile defined by points having positions that vary radially along a surface having an axis of rotation that extends in a stroke direction of the punching element.

The punch 44 is used together with a die 64 (FIGS. 15 to 25) in a punch and die assembly 43. The die 64 has a die plate 68 that supports a workpiece 72 when the workpiece 72 is sheared and formed. The workpiece 72 can be in the form of a sheet of commercial forming steel, as described above, used for forming steel beams, such as the steel beam 10, described above. The die plate 68 can be of wear plate.

The die plate 68 has four die openings 63 that open into slug discharge holes 62. The openings 63 have flared die faces 74 for facing the flaring surface 54 of the punch flaring element 52 such that the aperture 12 in the workpiece 72 is flared by the flaring element 52 and the perimeter portion 74 in the working stroke. In these drawings, the die 64 is shown with one die opening 63. Thus, the embodiments of the punch and die assemblies described herein include the punch 44 and the die 64 with one opening 63 corresponding to the punch 44. As described below, the opening 63 can be one of four openings in the die 64.

The punching element 36, specifically the working portion 49, can have a diameter of from 70 MT to 80 MT. In this example, the working portion 49 has a diameter of 75 MT. The flaring element 52 can have a diameter of from 90 MT to 100 MT. In this example, the flaring element 52 has a diameter of 93.75 MT.

A punching element according to an aspect of the invention can have any practicable attaching means for attaching the punching element to a tool or machine for punching the workpiece. FIGS. 8 to 11 illustrate four bolts 56 secured within passages 57 defined in the base portion 47 and extending from the flaring element 52.

Figure 12:
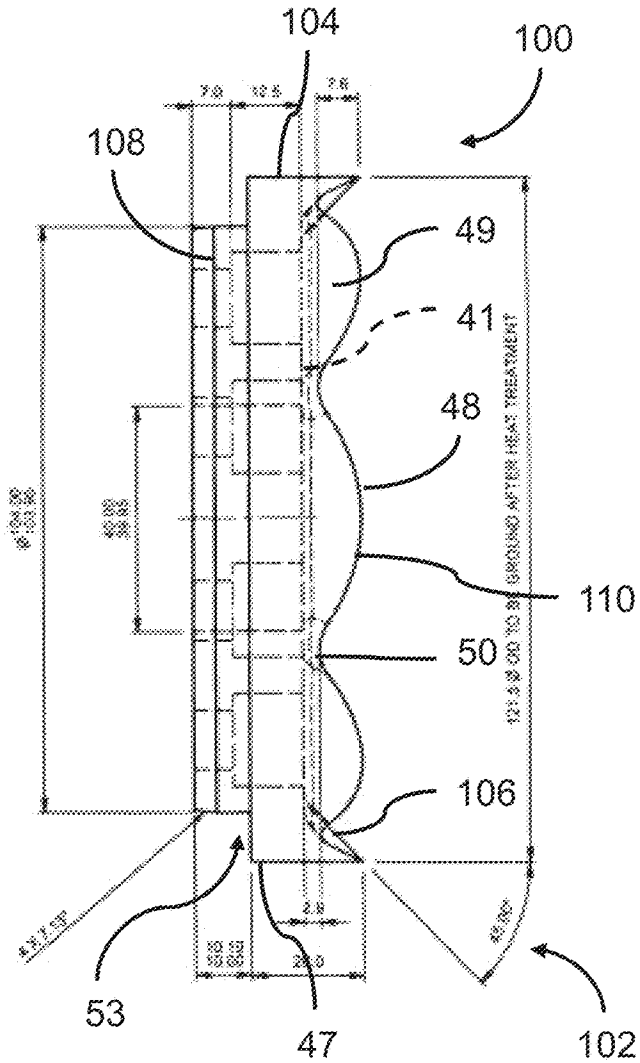
FIG. 12 shows a side view of one example of a punching element, according to an aspect of the invention, of one embodiment of a punch and die assembly, according to an aspect of the invention.

In FIG. 12, reference numeral 100 generally indicates one example of a punching element of one embodiment of a punch and die assembly, in accordance with the invention. With reference to the preceding drawings, like reference numerals refer to like parts, unless otherwise specified. The common use of reference numerals is not intended to be limiting and is solely for the purposes of clarity of description and convenience. The punching element 100 is substantially the same as the punching element 36 and is set out separately below in order to describe the various dimensions that are applicable to the flaring element 36, as well.

An included angle 102 (the "back angle") defined by radial profiles of an outer surface 104 and an inner surface 106 of the working portion 49 is between approximately 42° and 48°. In this example, the angle 102 is 45°. Thus, the working portion 49 has a back angle of 45° to define a working edge 110.

The height of the working portion 49, measured from the face 41, is between approximately 9 mm and 12 mm. In this example, the height is 10.5 mm.

Each peak 48 defines an axial profile with a complex curve having an average radius of between approximately 28 mm and 33 mm. In one example, the radius is 31 mm. The way the complex curve is created is described below with reference to FIGS. 26 to 36. Furthermore, in this example, each peak 48 has a height of between approximately 6 mm and 8 mm, for example, 7.5 mm. The troughs or valleys define an axial profile having a radius of between approximately 5 mm and 15 mm. In one example, the radius is 10 mm. These values can vary depending on the thickness and type of material being punched.

The outer surface 104 has a diameter of between approximately 120 mm and 123 mm. In this example, the outer surface 104 has a diameter of 121.5 mm. The base portion 47 has a height or length of between approximately 17 mm and 21 mm. In this example, the base portion 47 has a length of 19.5 mm. The shoulder 53 of the base portion 47 defines the stub 108 that fits into the passage 55.

It has been found that, for the steel described above, the dimensions of the punching element provide a suitably consistent clean separation of the slug from the workpiece. As a result, a forming assembly incorporating the punching element described above can provide significantly uninterrupted forming cycles without the need for manual removal of slugs. Furthermore, it has been found that, with such dimensions, the slug and associated parts of the workpiece are substantially free from deformation and damage.

In particular, the back angle 102 is selected so that there is a suitable combination of cutting and shearing ability of a working edge 110 of the working portion 49 and structural integrity of the working portion 49. That structural integrity is further optimised by the number of peaks and troughs 48, 50 and their associated extents of curvature. For example, as set out above, the punching element 22 has twenty peaks and twenty troughs. That punching element 22 has high structural integrity but reduced cutting and shearing ability with the steel described above because the back angle is too high. On the other hand, the punching element 28 has twelve peaks and twelve troughs. That punching element 28 has low structural integrity, but high cutting and shearing ability with the steel described above because the back angle is too low. It follows that a suitable combination of structural integrity and cutting and shearing ability is achieved, at least in part, by an appropriate selection of a number of peaks and troughs and associated back angle.

It should be noted that the embodiments shown in FIGS. 2, 3 and 4 do not necessarily lack utility for workpieces of other materials or thicknesses. Furthermore, they may be useful for workpiece apertures of different dimensions. It follows that the various embodiments of the invention should be regarded as not being necessarily limited to embodiments with eight peaks and troughs and associated back angle described herein, also with reference to FIG. 13.

Figure 13:
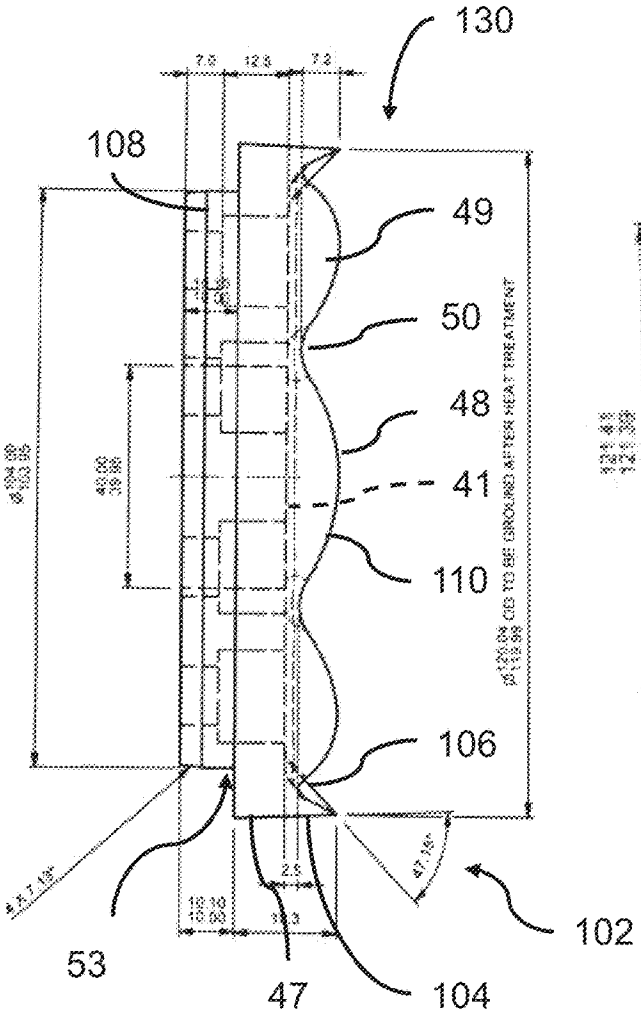
FIG. 13 shows a side view of another example of a punching element, according to an aspect of the invention, of one embodiment of a punch and die assembly, according to an aspect of the invention.

In FIG. 13, reference numeral 130 generally indicates a punching element of one embodiment of a punch and die assembly, in accordance with the invention. With reference to the preceding drawings, like reference numerals refer to like parts, unless otherwise specified. The common use of reference numerals is not intended to be limiting and is solely for the purposes of clarity of description and convenience.

The punching element 130 is identical to the punching element 100 with the exception of the outer surface 104 that tapers inwardly in the direction of the working stroke. The taper is between approximately 1.5° and 2.5°. For example, the taper is 2.15°.

Figure 14:
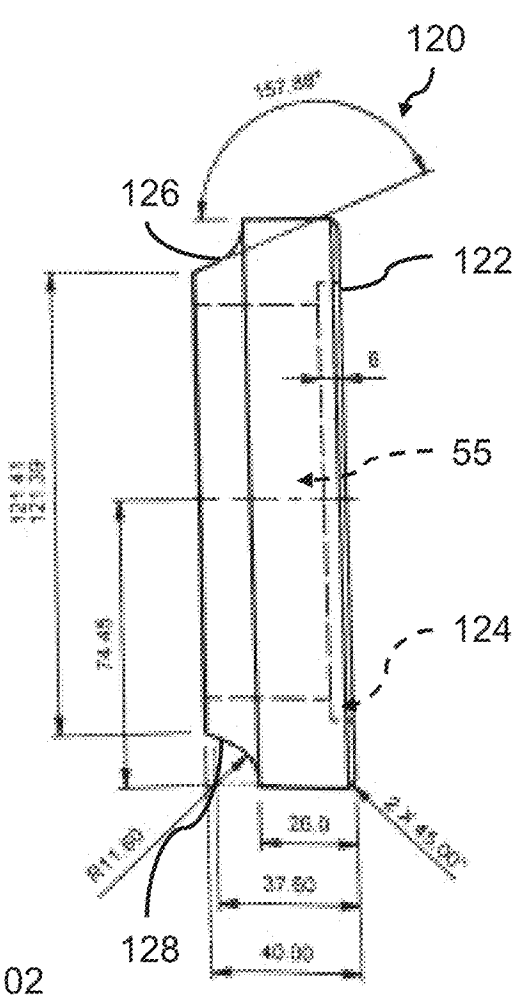
FIG. 14 shows a side view of one example of a flaring element of one embodiment of a punch and die assembly, according to an aspect of the invention.

In FIG. 14, reference numeral 120 generally indicates a flaring element of one embodiment of a punch and die assembly, in accordance with the invention. With reference to the preceding drawings, like reference numerals refer to like parts, unless otherwise specified. The use of common reference numerals is not intended to be limiting and is solely for the purposes of clarity and ease of description. The flaring element 120 is substantially the same as the flaring element 52, with the example of the flaring element 120 described with reference to dimensions that are applicable to the flaring element 52 as well.

The flaring element 120 has a base portion 122 that can be fastened to a punch bolster with the bolts 56. The base portion 122 defines the passage 55. The passage 55 is stepped at 124 to receive a locating formation of the punch bolster. The base portion 122 has a height of between approximately 24 mm and 28 mm. For example, the base portion 122 has a height of 26 mm.

The flaring element 120 has a flaring portion 126 that extends from the base portion 122. The flaring portion 126 defines a flaring surface 128 that tapers inwardly and in a direction of the working stroke. The flaring surface 128 has an arcuate axial profile. The arcuate profile has a radius of curvature of between approximately 9 mm and 13 mm. For example, the arcuate profile has a radius of curvature of between 10 mm and 13 mm, for example, 11.6 mm. The flared portion 126 has a height of between approximately 12 mm and 16 mm. For example, the flared portion 126 has a height of 14 mm.

It was found that the configuration of the punching elements 36, 100, 130 and the flaring element 52, 120, when assembled and used in a forming assembly suitable for forming structural steel beams with series of flared apertures, provides a punch that is capable of an acceptably consistent removal of a slug from the workpiece 72 with a minimization of damage to the punch.

Figure 15:
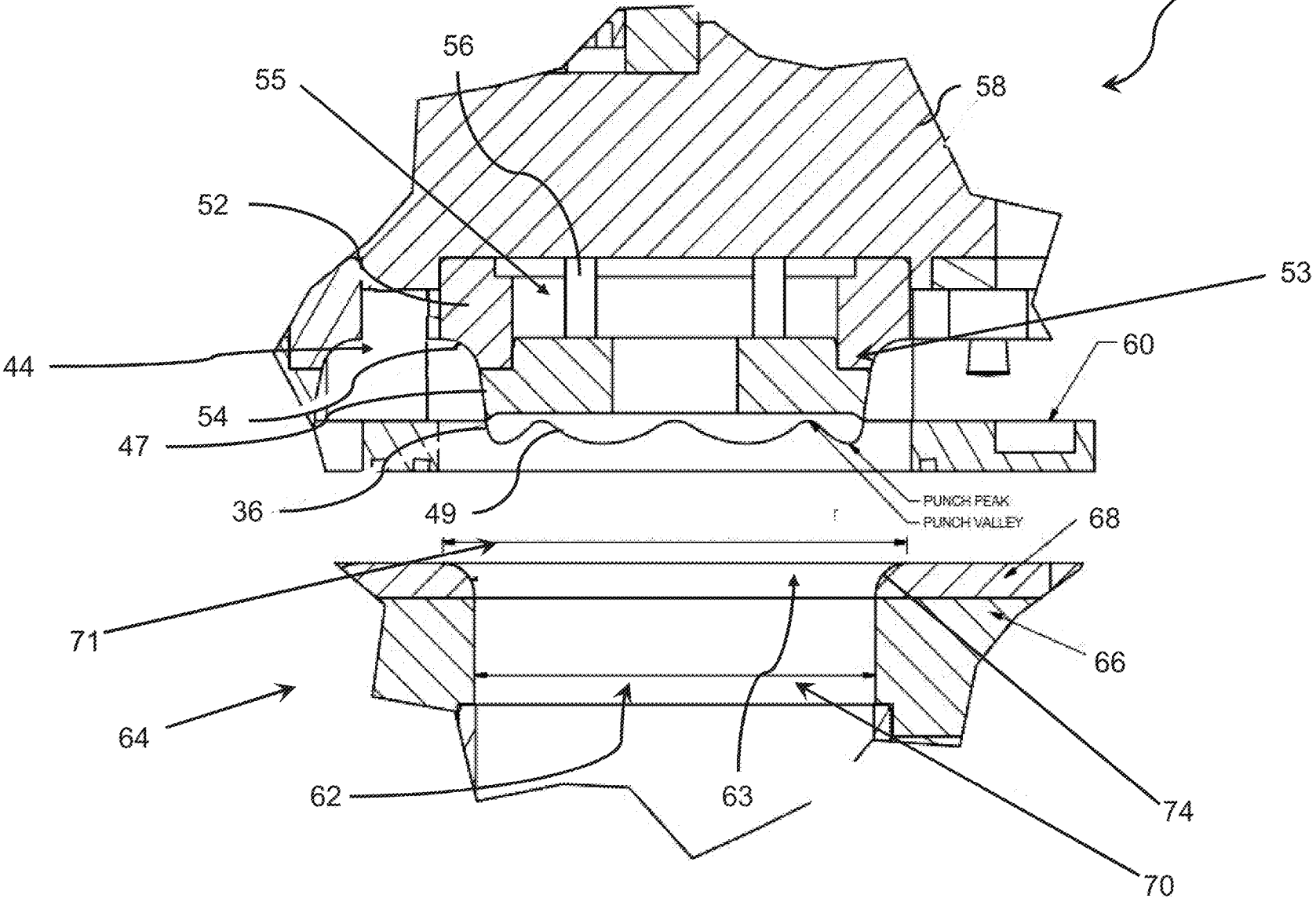
FIG. 15 shows a side sectioned view of one embodiment of a punch and die assembly according to an aspect of the invention, before positioning a workpiece.

In FIG. 15, reference numeral 43 shows an embodiment of a punch and die assembly, in accordance with the invention, suitable for use with a forming assembly having a series of such punch and die assemblies for the purposes of forming steel beams with webs having multiple flared openings or apertures. The punch and die assembly 43 is configured for a workpiece of a sheet of steel, as described above. The punching and flaring elements are suitable for use with the forming assembly described below having four punch and die assemblies, in accordance with the invention, for forming steel beams with webs having four flared apertures.

FIGS. 15 to 23 illustrate a process or method, according to an aspect of the invention, of punching and flaring a workpiece of the steel sheeting described above, using a punch and die assembly 43 according to an aspect of the invention. With reference to the preceding drawings, like reference numerals refer to like parts, unless otherwise specified. The use of common reference numerals is not to be considered limiting and is solely for the purpose of clarity and ease of description.

The punch 44 is attached to a punch bolster 58 using the bolts 56. A stripper plate 60 is shown, connected to a stripper plate drive spring 61 (see FIG. 24) in a conventional manner. The punch 44 is positioned above the die 64, which includes the die plate 68 and a die bolster 66, through which the discharge hole 62 and die opening 63, respectively, extend. The opening 63 is defined by the flared die face 74. The punching element 36 is positioned centrally above the die opening 63 and the slug discharge hole 62. The punching element 36 progresses at least partially into the slug discharge hole 62 during a working stroke of the assembly 43.

The die opening 63 and the slug discharge hole 62 have a minimum diameter (at 70 for the hole 62 in FIG. 15) that is larger than a diameter of the punching element 36. In this example, the minimum diameter 70 is between 80 MT and 90 MT, for example 82.5 MT. A maximum diameter at 71 of the flared die face 74 can be from 90 MT to 100 MT and can be from 10 MT to 20 MT greater than the diameter of the punching element 36. In this example, the maximum diameter 71 of the flared die face 74 is 92.5 MT. It will be appreciated that the punching element 36 is interchangeable with the punching element 100, 130 described above, for the purposes of ascertaining various suitable dimensions. The same applies to the flaring element 52, which is interchangeable with the flaring element 120.

Figure 16:
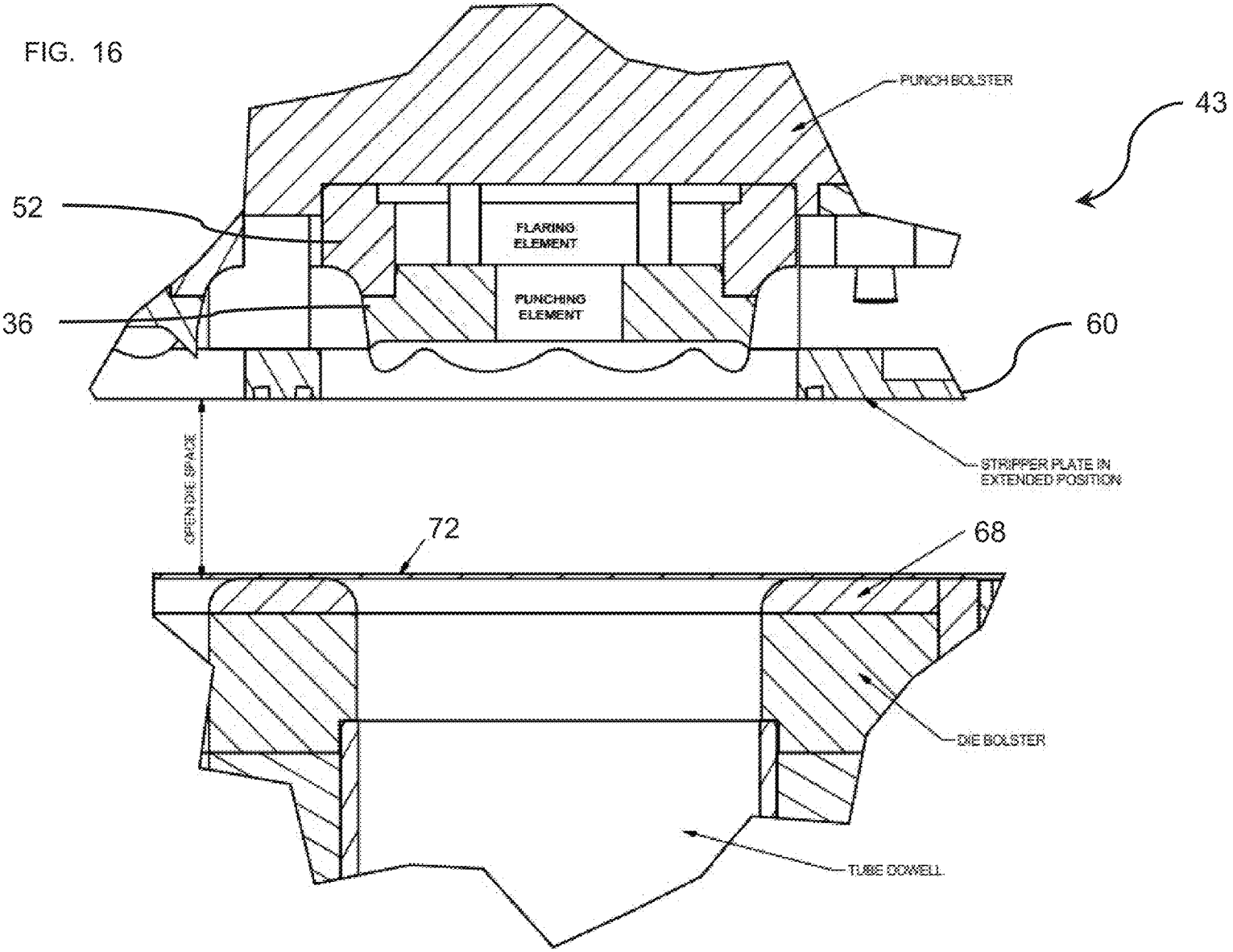
FIG. 16 shows a side sectioned view of the punch and die assembly of FIG. 15 with the workpiece positioned on a die plate of the assembly.

FIG. 16 shows the workpiece 72, on the die plate 68, prior to punching and flaring the workpiece 72. The workpiece 72 is a sheet of steel, as described above, suitable for forming a steel beam, for example, the steel beam 10, described above.

Figure 17:
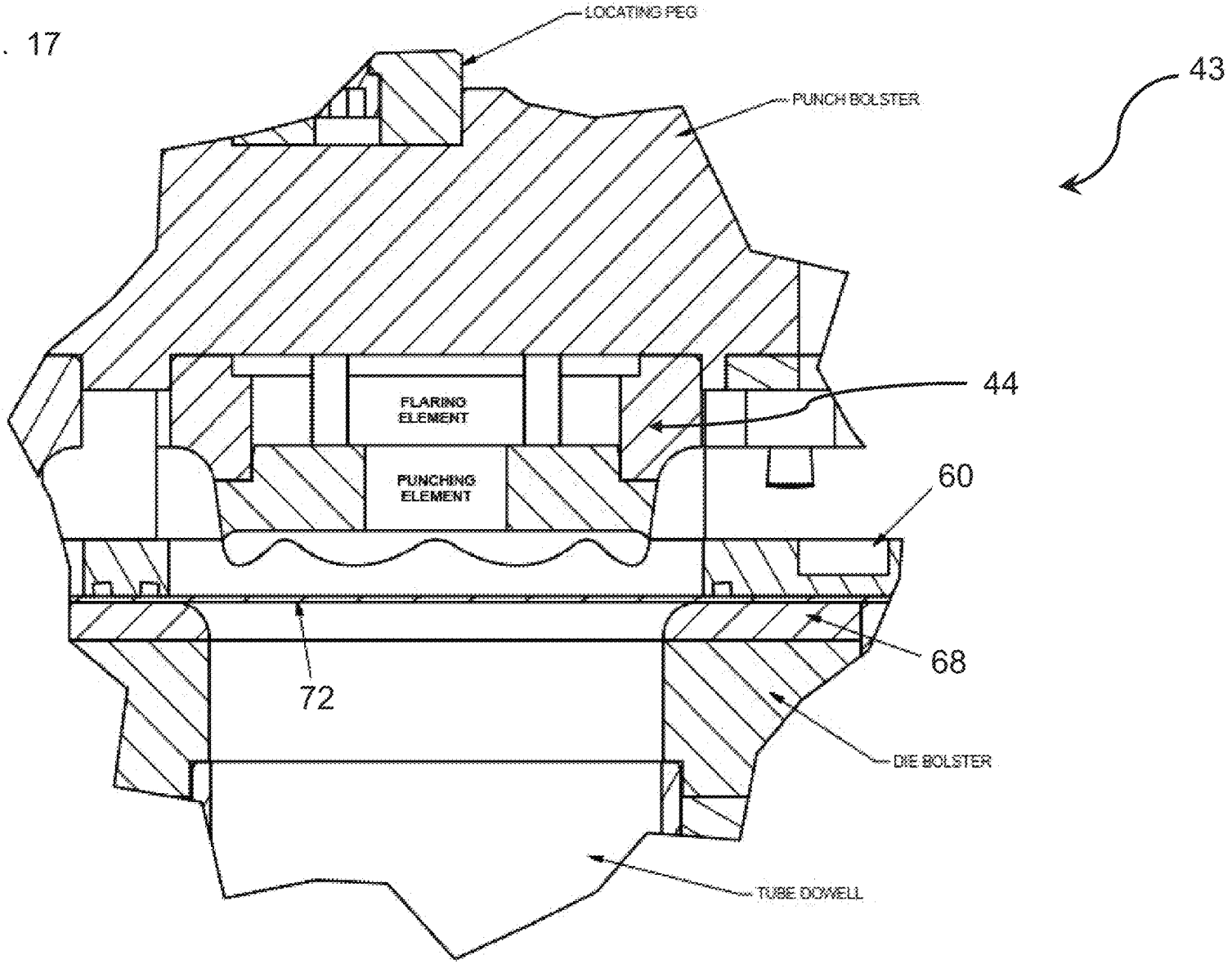
FIG. 17 shows a side sectioned view of the punch and die assembly of FIG. 15 during a working stroke with a stripper plate retaining the workpiece on the die plate.

FIG. 17 shows advancement of the punch 44 towards the workpiece 72 during a working stroke of the punch 44. As shown, the stripper plate 60 is positioned to clamp and stabilise the workpiece 72 between the die plate 68 and the stripper plate 60 prior to punching of the workpiece 72.

Figure 18:
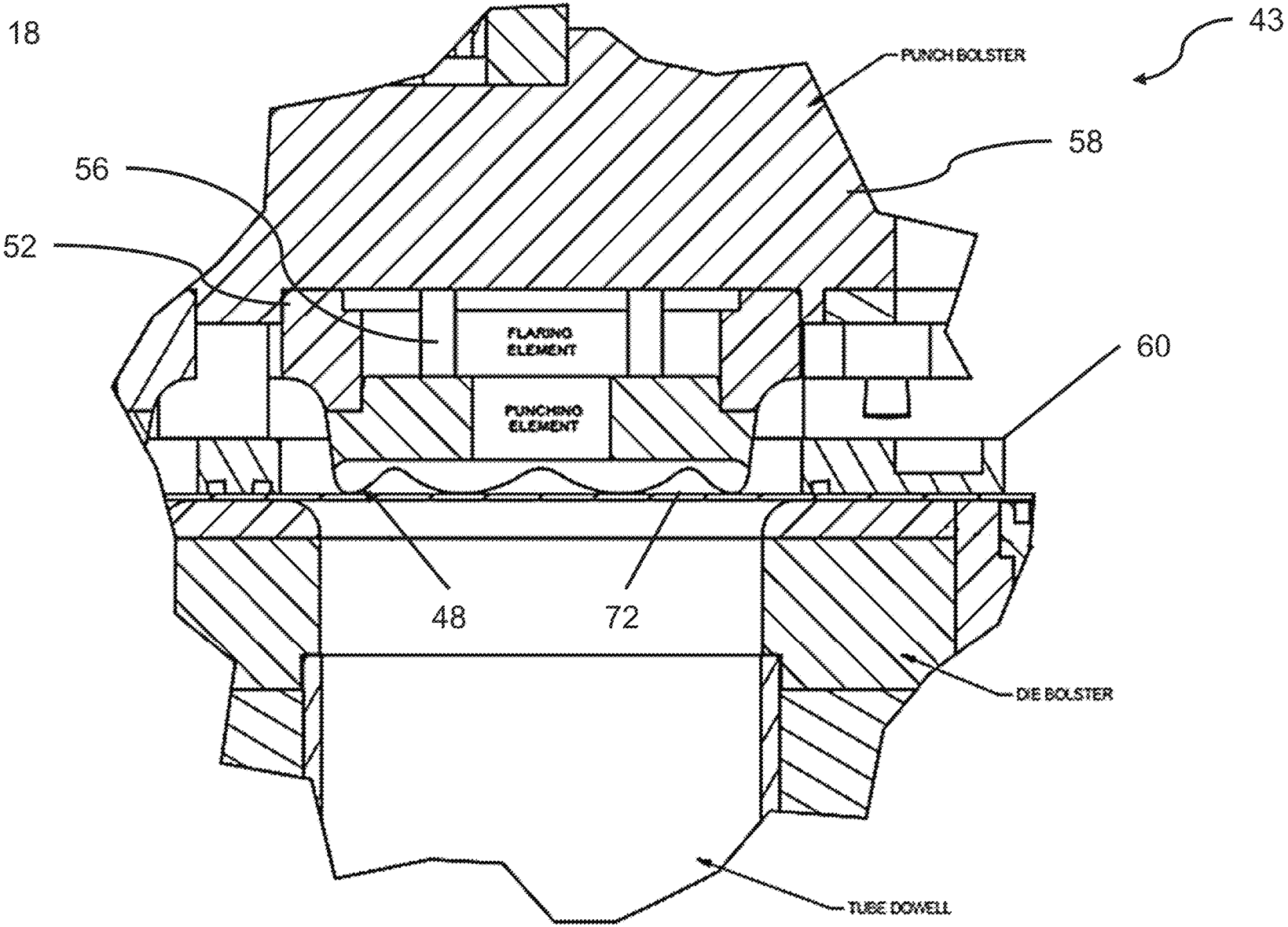
FIG. 18 shows a sectioned side view of the punch and die assembly of FIG. 15 during a working stroke with a working portion of a punch impinging on the workpiece.

FIG. 18 shows the peaks 48 impinging on the workpiece 72, while the stripper plate 60 retains the workpiece 72 between the die plate 68 and the stripper plate 60.

Figure 19:
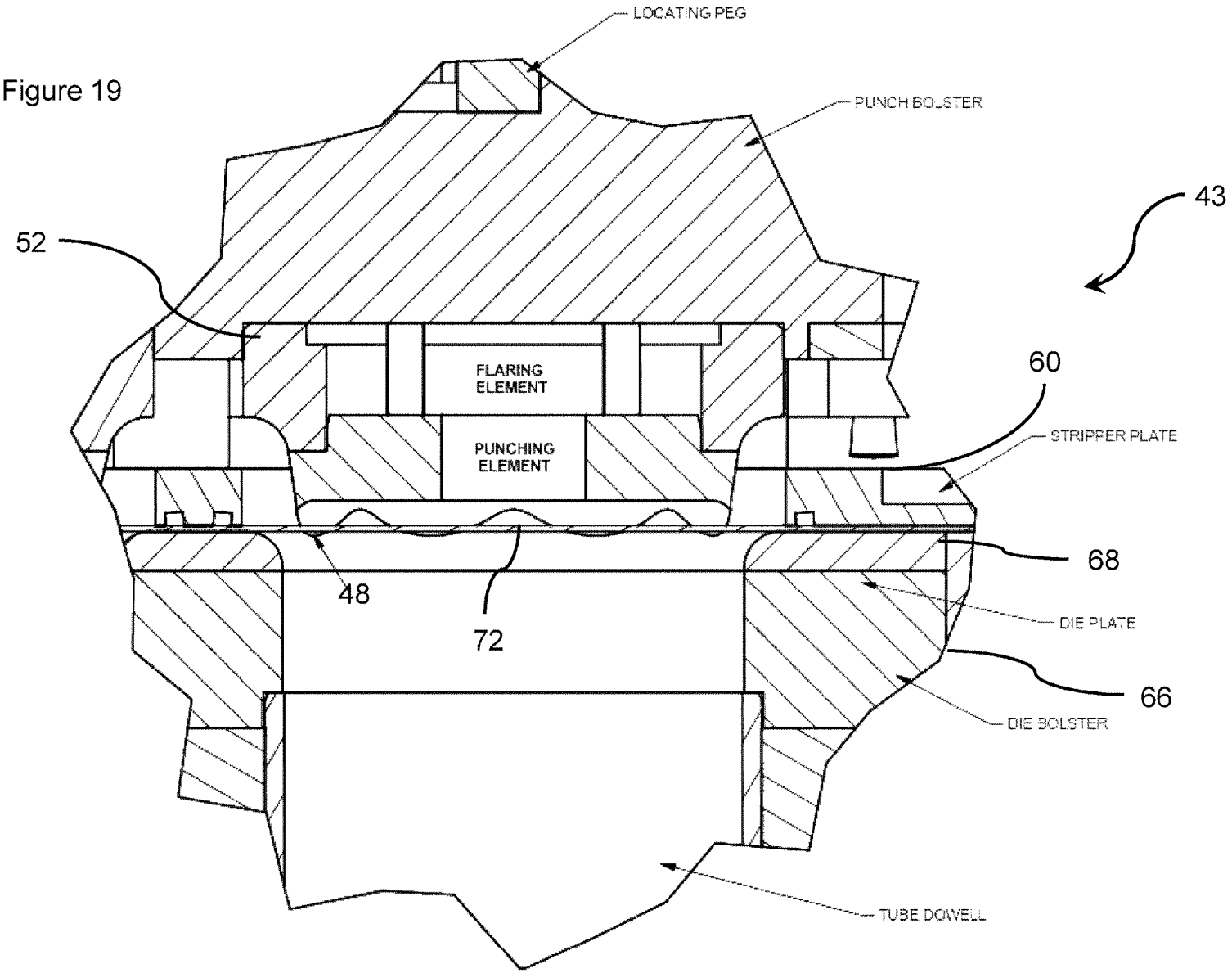
FIG. 19 shows a sectioned side view of the punch and die assembly of FIG. 15 during a working stroke with the workpiece being partially penetrated.

FIG. 19 shows the peaks 48 penetrating the workpiece 72.

Figure 20:
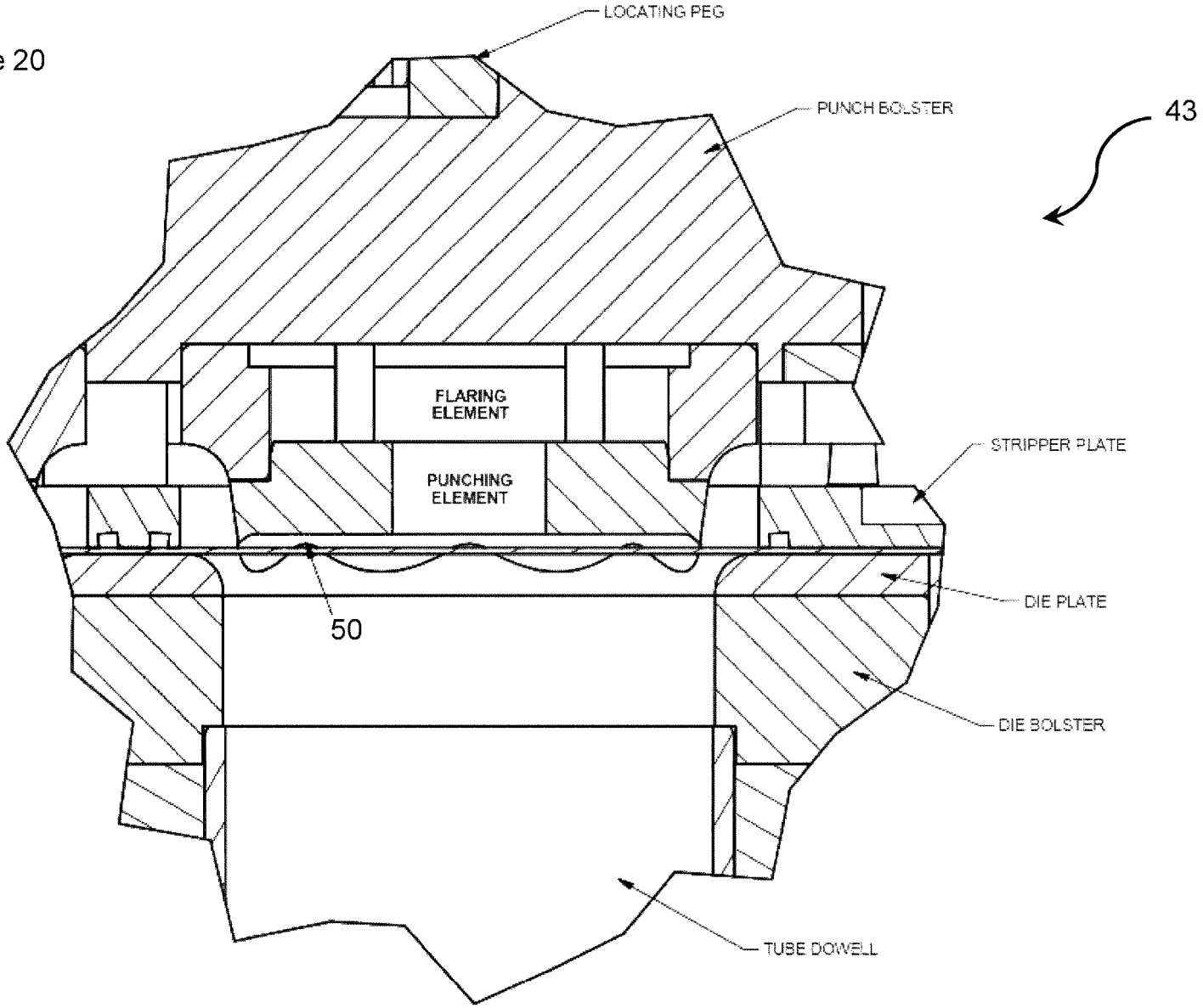
FIG. 20 shows a sectioned side view of the punch and die assembly of FIG. 15 during a working stroke with further penetration of the workpiece.

FIG. 20 shows downward progress of the punch 44, as the piercing and cutting effect of the peaks 48 progresses to a shearing action on the workpiece 72 by the troughs 50.

Figure 21:
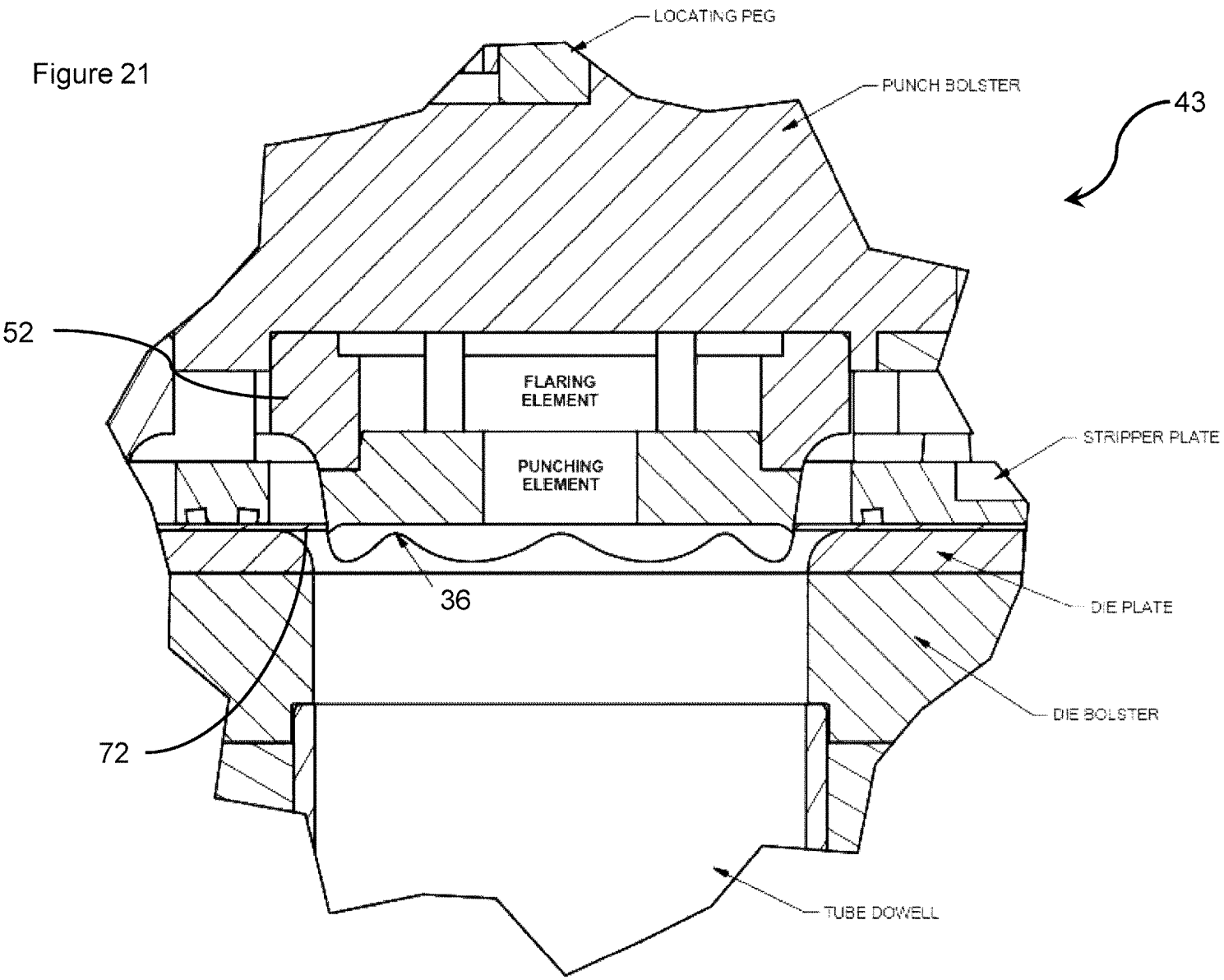
FIG. 21 shows a sectioned side view of the punch and die assembly of FIG. 15 during a working stroke with full penetration of the workpiece to form an aperture.

FIG. 21 shows a final breakout of a slug of material, leaving an aperture in the workpiece 72, with the slug 34 discharged through a tube dowel 129.

Figure 22:
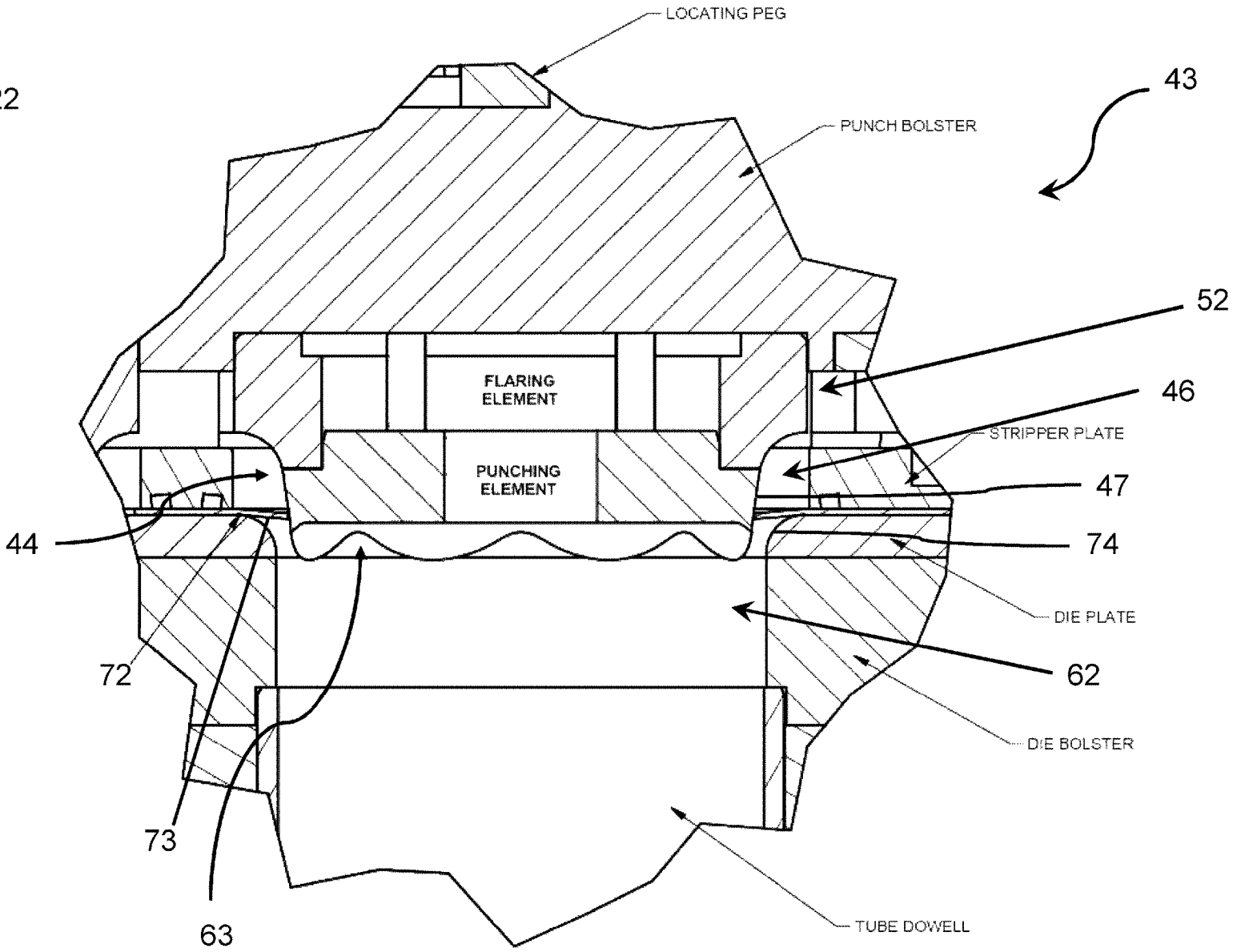
FIG. 22 shows a sectioned side view of the punch and die assembly of FIG. 15 during a working stroke with partial formation of a flared perimeter of the opening.

FIG. 22 illustrates the further progression of the punch 44 partially through the die opening 63 after breakout of the slug of material. The base portion 47 of the punching element 36 draws a perimeter portion 73 of the workpiece 72 over the flared die face 74.

Figure 23:
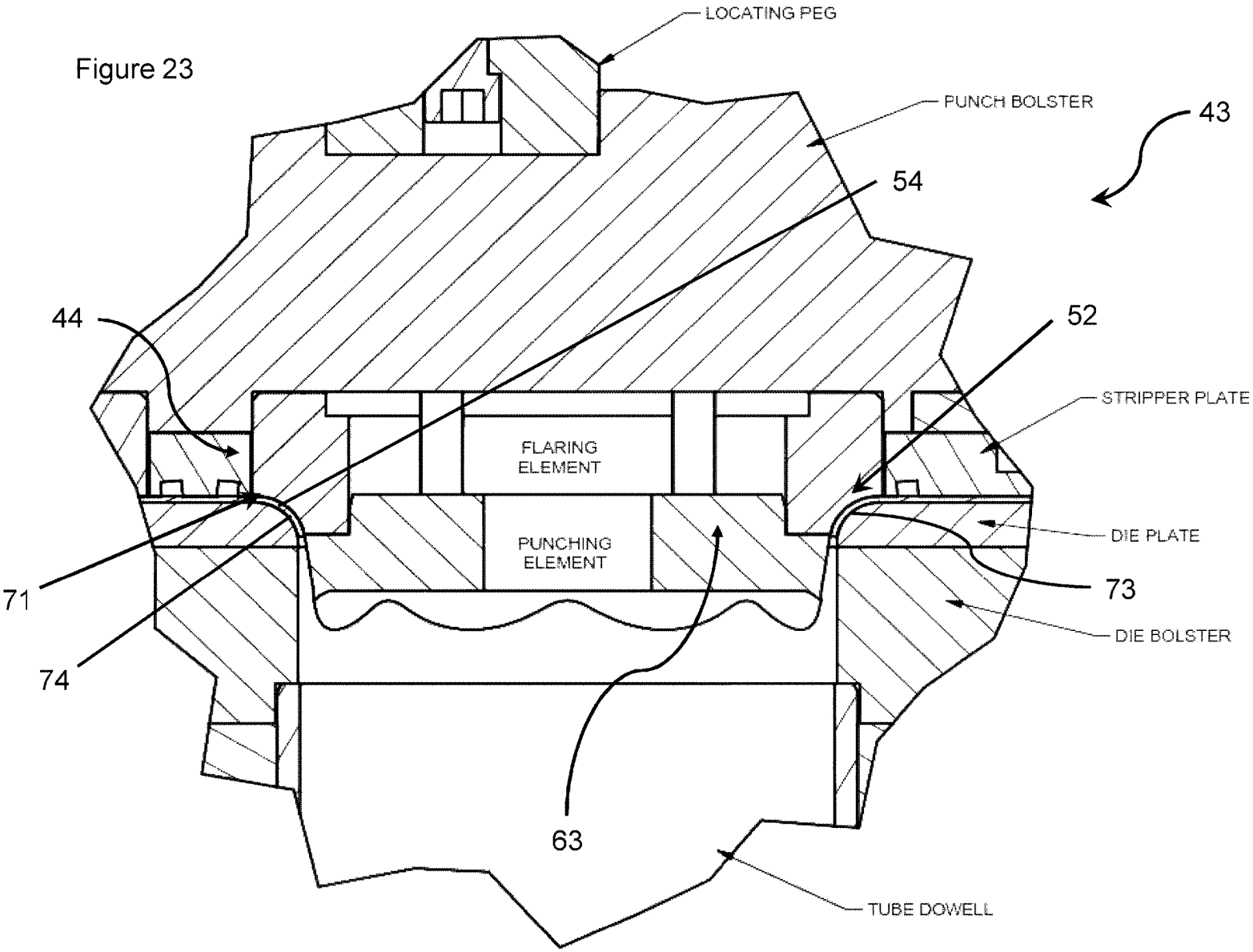
FIG. 23 shows a sectioned side view of the punch and die assembly of FIG. 15 at a termination of a working stroke with full formation of the flared perimeter.

FIG. 23 illustrates the completed punch and flare action. The flaring element 52 of the punch 44 presses the perimeter portion 73 between the arcuate flaring surface 54 of the punch 44 and the flared die face 74 of the die opening 63. Upon disengagement of the assembly 43, a sheet of material including a flared aperture such as the aperture 12 in FIGS. 1 and 2, is provided.

Figure 24:
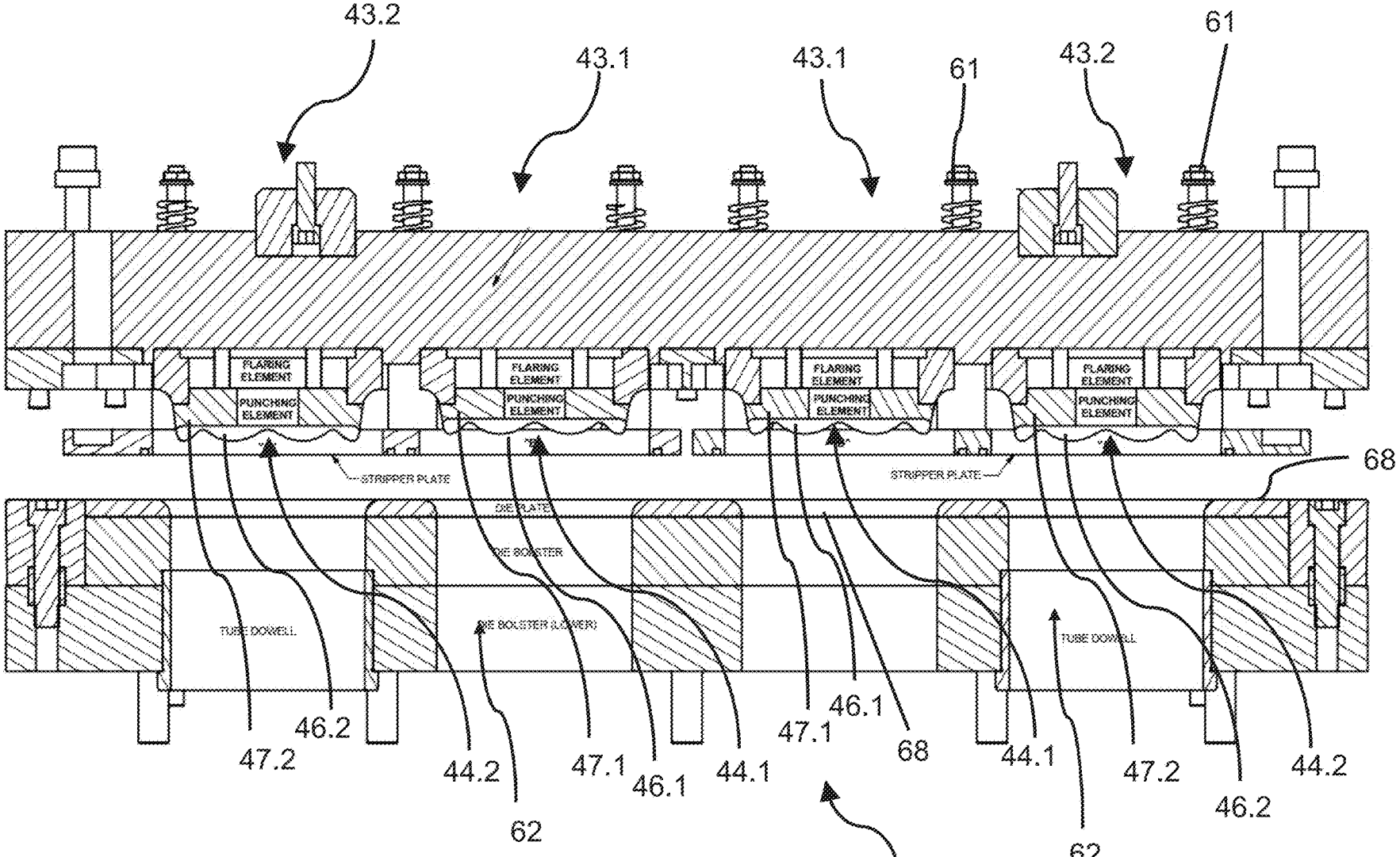
FIG. 24 shows a sectioned side view of an embodiment of a forming assembly, in accordance with the invention, having a series of an embodiment of a punch and die assembly, in accordance with the invention.
Figure 25:
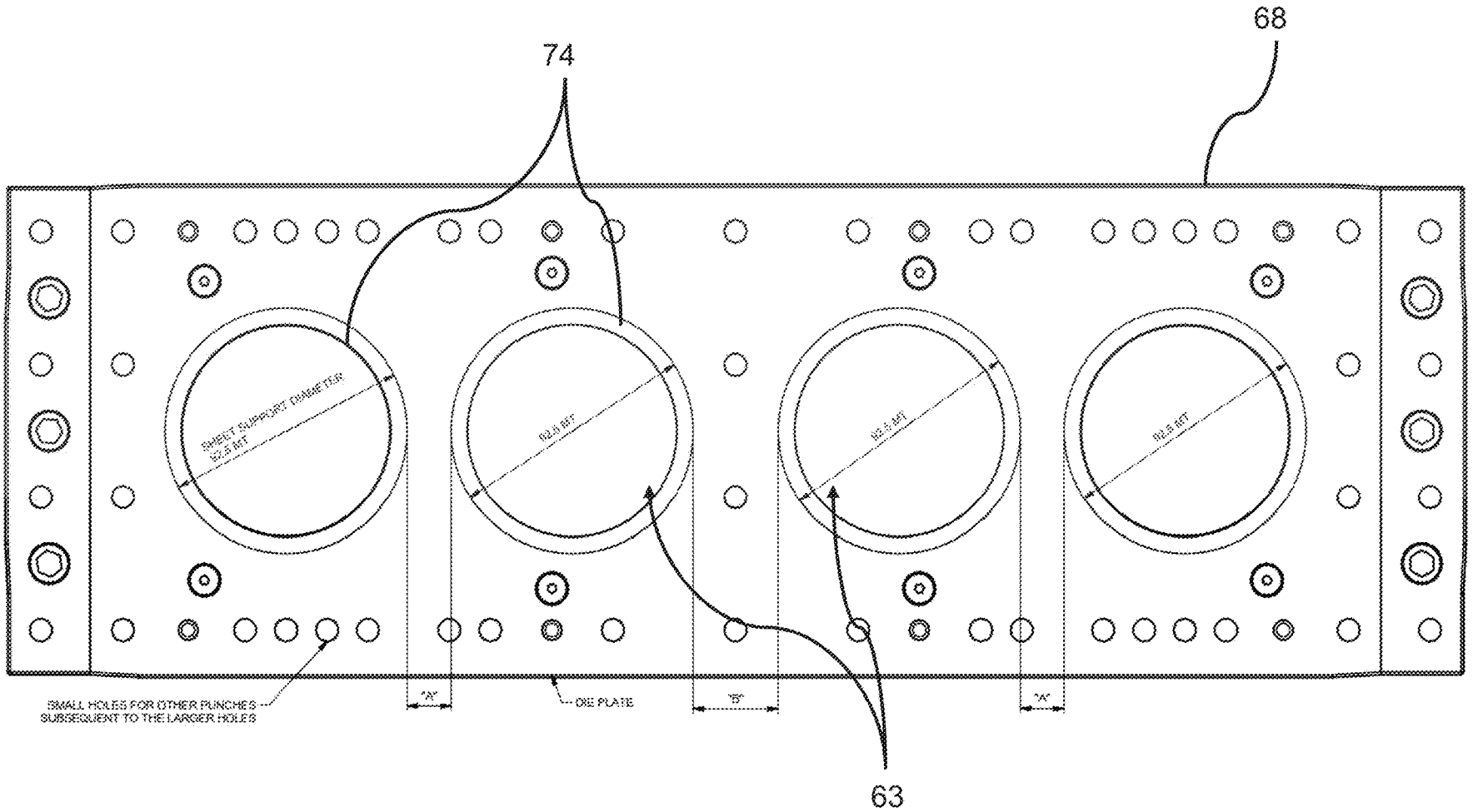
FIG. 25 shows a die plate of a die for the forming assembly of FIG. 24.

In FIG. 24, reference numeral 45 generally indicates one embodiment of a forming assembly, in accordance with the invention, suitable for use with forming machinery for forming a steel beam 10, as described above and in PCT '381. With reference to the preceding drawings, like reference numerals refer to like parts, unless otherwise specified. The use of common reference numerals is not to be considered limiting and is solely for the purposes of clarity and ease of description.

The forming assembly 45 includes four colinear punch and die assemblies 43.1, 43.2 according to the invention. Each punch and die assembly 43.1, 43.2 can be optimally spaced relative to the other assemblies. The punch and die assemblies 43.1 are inner punch and die assemblies. The punch and die assemblies 43.2 are outer punch and die assemblies. A similar numbering format has been used to denote components of the inner and outer punch and die assemblies 43.1, 43.2, respectively.

The punching elements 36.1 of the punches 44.1 have a base portion 47.1 that is shorter than the base portion 47.2 of the punching elements 36.2. For example, the base portion 47.1 can be 2.8 MT shorter than the base portion 47.2. Other differentials or configurations, such as shims or mounts, can be used, depending on the application, the goal being to have the punching elements 47.2 impinge on the workpiece before the punching elements 47.1.

Referring to the beam 10 of FIG. 2, using the forming assembly 45 to form the flared apertures 12.1, 12.2, the two outer flared apertures 12.2 are created first and the two inner flared apertures 12.1 are created thereafter as a result of the difference in length of the base portions 47.1 and 47.2. This allows the material about the two inner flared apertures 12.1 to be properly supported during the punching operation, and vice versa. This can avoid buckling or distortion of the material during the punching and flaring operations because the stresses generated when forming the respective apertures 12.1, 12.2. are kept relatively isolated, as opposed to an arrangement wherein all the apertures 12.1, 12.2 are formed substantially simultaneously. The four flared apertures 12.1, 12.2 of the beam 10 in FIGS. 1 and 2 can be made in a single operation, using a single station. Other configurations of assemblies 43 are envisaged, depending on the configuration of multiple flared apertures required.

In FIGS. 26 to 36 there are shown various stages in a modelling process to generate a model of the punching element 130 (FIG. 13). This process can also be used, with minor variations, to generate a model of the punching element 36, 100. Note that the following paragraphs are not intended to describe a fabrication process, which will be performed by, for example, a CNC machine. Rather, the following paragraphs are intended to illustrate the way in which the shape of a punching element, in accordance with the invention, is achieved. It will be appreciated that the shape of the punching element 130 and the other embodiments of the punching element described herein is relatively complex and not readily formed. The inventor has conceived and developed a method of modelling the complex shape representing the various embodiments of the punching element described herein.

Figure 26:
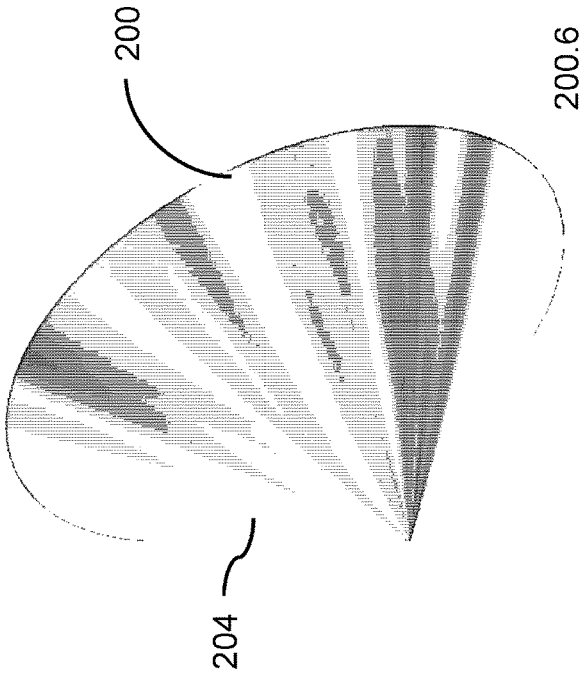
FIG. 26 shows a primary element used in a three-dimensional modelling process to model an embodiment of a punching element, in accordance with the invention, of the punch and die assembly.

FIG. 26 shows a primary element or solid cone 200 that forms the basis of the modelling process. The cone 200 is generated by setting a line of indeterminate length on a cartesian plane. The line can extend from an x-axis at a suitable angle. It has been found that 45° is an appropriate angle for various embodiments of the punching element. However, other angles may also be appropriate depending upon the application. The line can intersect with the x-axis at a predetermined distance from the origin of the cartesian plane. In this example, that distance can be 0.75 mm. However, it has been found that the distance from the origin does not have a significant effect on the resultant model. A surface of the solid cone 200 is developed by rotating the line through 360° about the x-axis. A resultant volume is filled. Thus, the solid cone 200 has a 45° sidewall 204 and is of indeterminate height. The 45° sidewall sets the back angle 102 of the working portion 49, described above.

Figure 27:
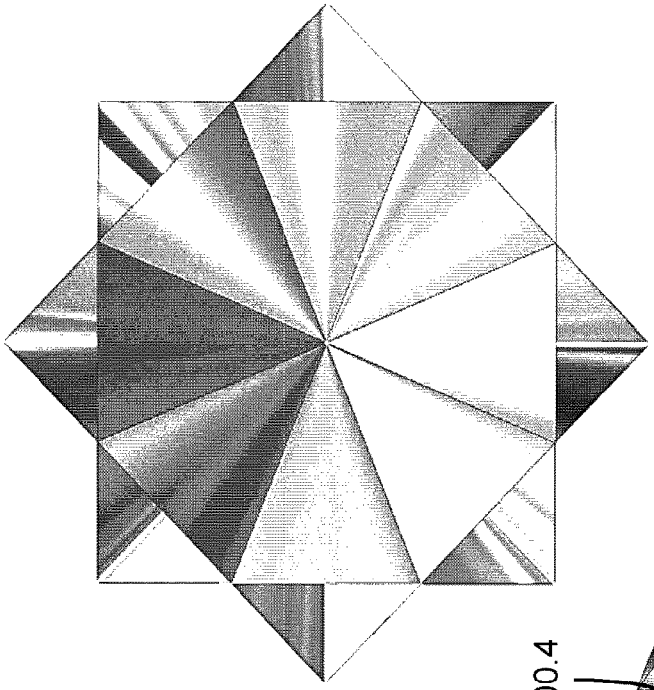
FIG. 27 shows a plan view of eight of the primary elements of FIG. 26 positioned in intersecting relationship to define a model from which the punching element is to be formed.
Figure 28:
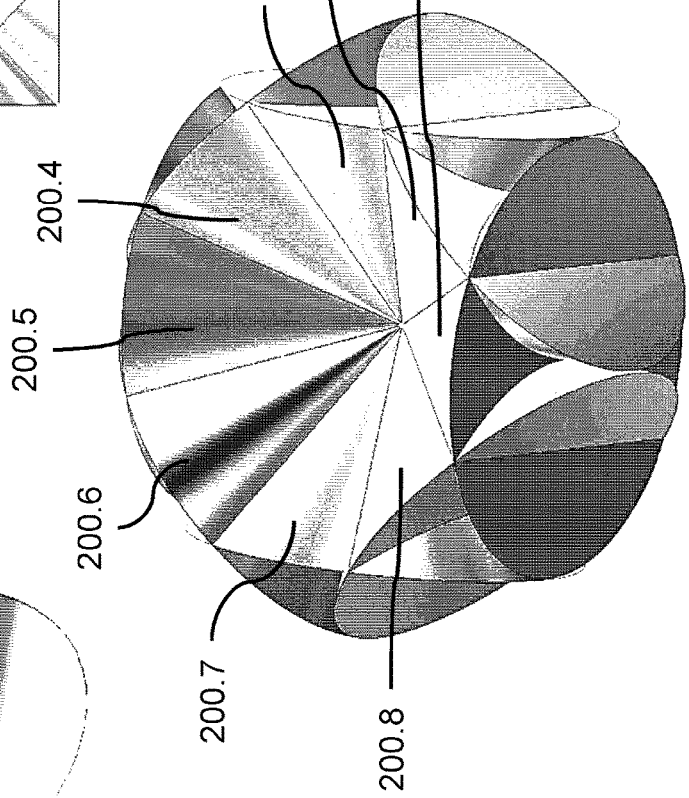
FIG. 28 shows a three-dimensional view of the model of FIG. 27.

The cone 200 is then replicated evenly about a y-axis such that eight cones 200.1 to 200.8 are bisected by an x-z plane with apices of the cones each being positioned at the above-mentioned distance from the origin as can be seen in FIGS. 27 and 28. The relationship between a vertical central axis (the y-axis) of the arrangement of cones 200 and the apices of the cones 200 determines a height of the peaks 48 of the punching element. It will be appreciated that the eight cones 200 provide eight peaks 48, as described above.

Figure 29:
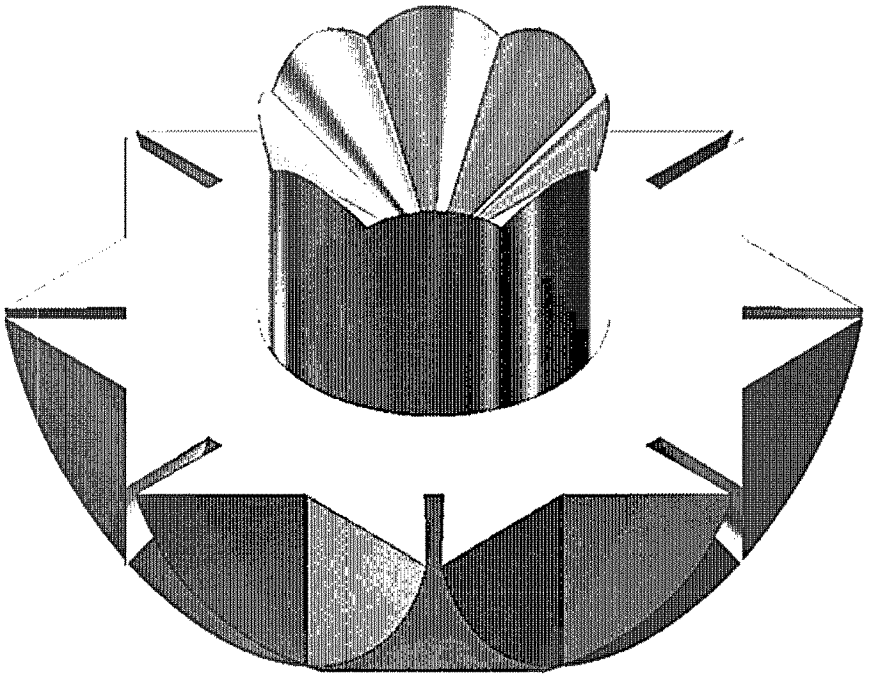
FIG. 29 shows the model of FIG. 27 with an upper portion of each primary element removed to leave a cylindrical core having a diameter of that of the punching element.

As shown in FIG. 29, an appropriate corresponding portion of each cone 200 is removed to expose an intended working diameter of the punching element.

Figure 30:
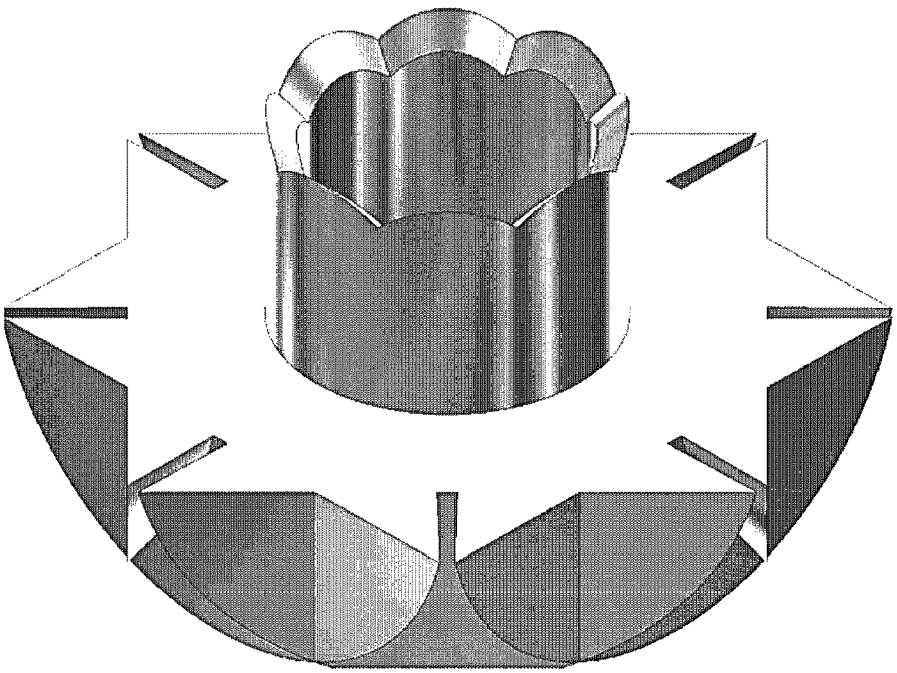
FIG. 30 shows the model of FIG. 29 with a central cylindrical portion removed to leave a model representing peaks of a working edge of the punching element.

As shown in FIG. 30, a central passage is created to expose peaks to represent the peaks 48 of the cutting element.

Figure 31:
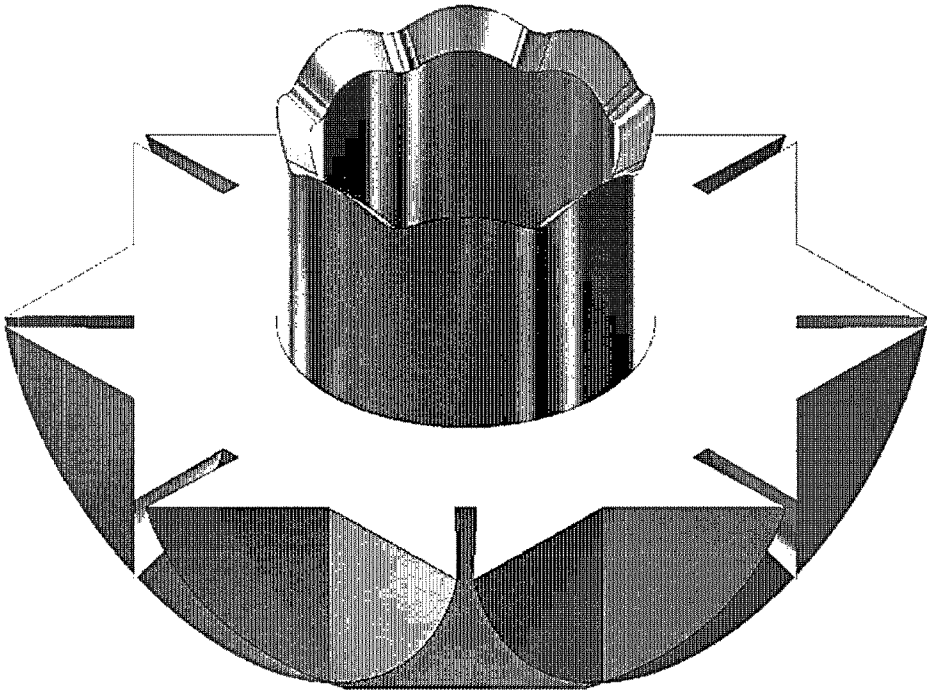
FIG. 31 shows the model of FIG. 30 with cylindrical troughs formed between the peaks to represent troughs of the working edge.

As shown in FIG. 31, troughs or valleys are formed between the peaks. The radii of the troughs or valleys are selected in accordance with the intended peak height as set out above. The radii can vary depending on the thickness and type of material being punched.

Figure 32:
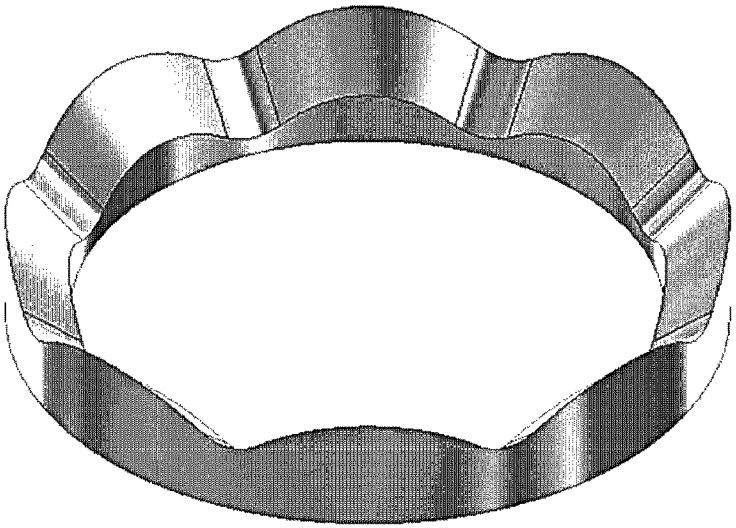
FIG. 32 shows the model of FIG. 31 with a lower bulk removed so that a remaining portion represents a working portion of the punching element.

As shown in FIG. 32, waste material is removed to facilitate the addition of mounting elements of the cutting element.

Figure 33:
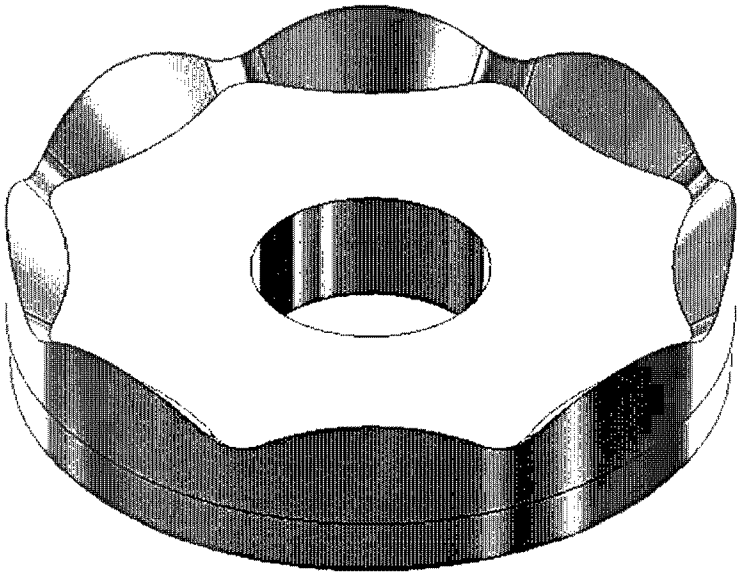
FIG. 33 shows the model of FIG. 32 with an added portion representing the base portion.

As shown in FIG. 33, a central area is filled to provide material for the mounting elements. A further zone is filled to form an area for the stub 108. A hole is formed in the central area. It is to be noted that the hole is non-prescriptive, and its existence depends on the way the cutting element is to be mounted.

Figure 34:
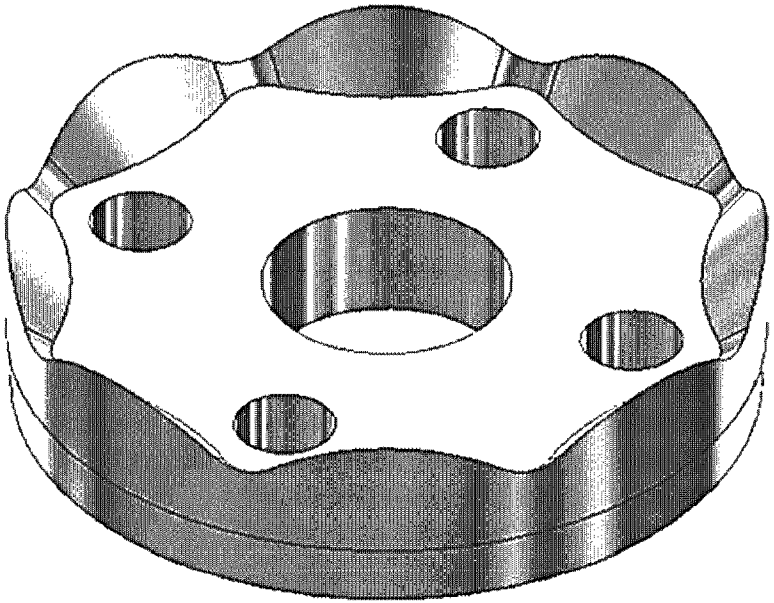
FIG. 34 shows the model of FIG. 33 with mounting holes formed in the represented base portion.

As shown in FIG. 34, mounting holes are formed in the material. Again, the mounting holes are non-prescriptive and depend on the way the cutting element is to be mounted.

Figure 35:
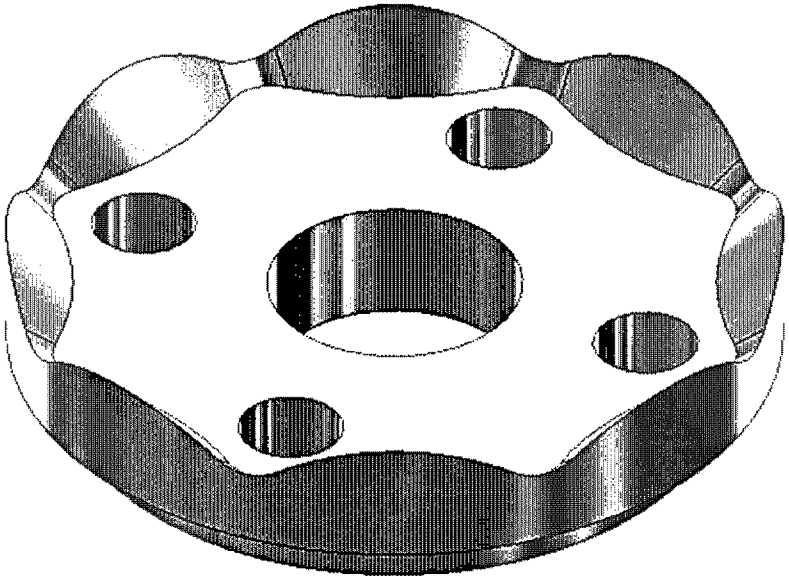
FIG. 35 shows the model of FIG. 34 with an annular portion removed from the represented base portion to represent a stub for mounting purposes.

As shown in FIG. 35, material is removed to form a boss or the stub 108. The boss is non-prescriptive and depends on the way the cutting element is to be mounted.

Figure 36:
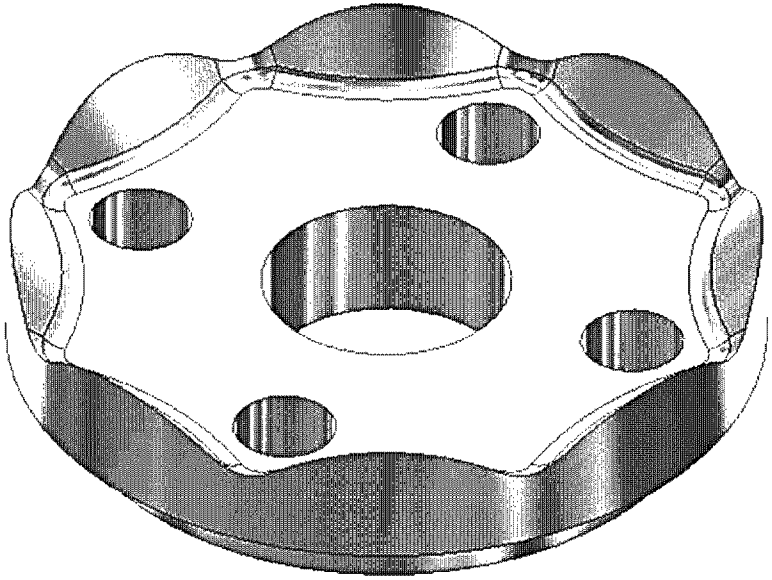
FIG. 36 shows the model of FIG. 35 with strengthening fillets.

As shown in FIG. 36, a junction between the peaks, valleys and the added material is filleted to add robustness to the working portion of the cutting element. Again, the size of the fillets is not prescriptive. For example, if they are too small, the integrity is weakened and if they are too large, they can impact on the back angle referred to above.

The way the punching element is modelled can be used to provide a working portion with a profile and a back angle to optimise piercing of the workpiece and a transition to shearing and release of the slug.

In the above embodiment, the punching element has eight peaks and troughs. However, it has been found that the punching characteristics are most significantly adjusted by adjusting the number of peaks and troughs. For example, for steel plate having higher strength characteristics than the strength characteristics of the workpiece described above, for example, thicker steel plate, the punching element could have seven, or less, peaks. Thus, the modelling process could include the use of seven (or less) of the primary elements described above, instead of eight. This would increase the structural integrity of each peak, to accommodate the higher strength characteristics, with a corresponding reduction in piercing ability. It follows that for steel plate having lower strength characteristics than the strength characteristics of the workpiece described above, the punching element could have more than eight peaks. This would decrease the structural integrity of each peak but improve the piercing ability of the punching element. Such an arrangement could be suitable for thinner steel plate, for example. In this case, the modelling process above could include the use of more than eight of the primary elements described above. The modelling process could also use nine or more of the primary elements described above for larger apertures to be formed in the steel.

Furthermore, depending on the application, the sidewall of the solid cone can have a lesser angle, determined by the line intersecting with the x-axis, where a greater back angle is required. This may be the case where the steel plate has higher strength characteristics, as described above. The sidewall of the solid cone can have a greater angle, determined by the line intersecting with the x-axis, where a lower back angle is required. This may be the case where the steel plate has lower strength characteristics, as described above.

The punch and die assemblies and forming assemblies can be portable and compact, and can operate at high speeds, as both actions of punching and flaring are effected by a single assembly.

Furthermore, when a number of the forming assemblies are located in series within a beam forming machine, for example, the beam forming machine of PCT '381, the machine can be used to form steel beams, as described above, on site because the machine is of a sufficiently low mass to be able to be towed, on a trailer, to a worksite. As discussed above, such utility is not available with conventional machines that would be used to form such steel beams.

A test was carried out using the forming assembly 45 described above, including the punch and die assemblies 43, on a workpiece of the commercial forming steel described above, that is, commercial forming steel sheet that is hot-dipped and zinc coated, with a thickness of 1.6 mm. The test involved taking measurements at various measurements of displacement of the outer punching element 36.2 from a start position during a working stroke to create an opening of 120 mm diameter. The measurements involved determining a force, in tons, exerted by the outer two punch assemblies 43.2. As described above, the outer punch assemblies 43.2 and the inner punch assemblies 43.1 act separately to form the apertures.

At 10 mm of displacement, the punching elements 36.2 made contact with the workpiece, without any significant changes to the workpiece. The force exerted by the two punch assemblies 43.2 was measured and calculated to be 3.436 tons.

At 10.5 mm of displacement, the punching elements 36.2 made depressions in the workpiece, but had not yet made any form of penetration. The force exerted by the two punch assemblies 43.2 was measured and calculated to be 5.154 tons.

At 11.5 mm of displacement, the peaks 48, but not the troughs 50, of the punching elements 36.2 had penetrated the workpiece. The force exerted by the two punch assemblies 43.2 was measured and calculated to be 7.731 tons.

At 13 mm of displacement, the peaks 48 and the troughs 50 of the punching elements 36.2 had penetrated into the workpiece, but the slug had not yet broken away. The force exerted by the two punch assemblies 43.2 was measured and calculated to be 12.026 tons.

At 18 mm of displacement, the peaks 48 and the troughs 50 had penetrated the workpiece completely and the slug had broken away and the flared rim was formed. The force exerted by the two punch assemblies 43.2 during this process was measured and calculated to be 17.181 tons.

It is to be noted that the measurements at 13 mm of displacement are most relevant for the punching out of the slug 42. After 13 mm, the inner punching elements 36.1 began to make contact with the workpiece, so increasing the measured punching force. Furthermore, a reactive load of the stripper plate 60 needs to be taken into account. This was approximately two tons. Thus, the measurement at 13 mm of displacement should be approximately 10 tons.

Thus, each punch assembly 43 would require a force of approximately 5 tons to punch out the slug 42. As set out above, with conventional multi-station equipment, the required force would be up to 27 tons. Thus, there is a significant reduction (greater than 25%) in the amount of force required to form openings, with embodiments of the punch and die assembly, in accordance with the invention, when compared to conventional equipment.

Furthermore, to form the flared aperture in the single working stroke, each punch assembly 43 would require a force of approximately 7.5 tons. This is still significantly less than the force required only to punch out the slug 42 with conventional equipment.

During the above tests, it was found that the minimum force exerted by the stripper plate 60 was 1.718 tons, while the maximum force exerted by the stripper plate was 3.779 tons. This is significantly less than that which would be required with punching forces in the region of 27 tons and above, as described above.

These reductions in force, when compared with conventional equipment, facilitate the mobility of a forming machine including one or more of the forming assemblies described herein.

These tests illustrate the manner in which the various embodiments of the punch and die assembly, in accordance with the invention, provide a means whereby a single-station machine can be provided that is mobile to allow steel components to be fabricated on site.

The appended claims are to be considered as incorporated into the above description.

Throughout this specification, reference to any advantages, promises, objects or the like should not be regarded as cumulative, composite and/or collective and should be regarded as preferable or desirable rather than stated as a warranty.

Throughout this specification, unless otherwise indicated, "comprise," "comprises," and "comprising," (and variants thereof) or related terms such as "includes" (and variants thereof)," are used inclusively rather than exclusively, so that a stated integer or group of integers may include one or more other non-stated integers or groups of integers.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

The term "and/or", e.g., "A and/or B" shall be understood to mean either "A and B" or "A or B" and shall be taken to provide explicit support for both meanings or for either meaning.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The invention claimed is:

1. A punch and die assembly for a forming assembly for forming flared openings in commercial forming steel sheeting, the punch and die assembly comprising: a punch that includes: a punching element having a base portion and a working portion that extends from a face of the base portion, the working portion defining a working edge with more than two substantially evenly spaced peaks and troughs for forming an opening in the steel sheeting during a working stroke; and a flaring element mountable on the base portion of the punching element, a side of the flaring element defining an arcuate flaring surface that tapers inwardly in the direction of the working stroke and is in register with the working portion to define a continuous transition from the flaring surface to an external surface of the working portion, wherein the base portion of the punching element is stepped to define a shoulder so that a stub of the base portion can nest in a passage defined by the flaring element to locate the punching element relative to the flaring element; and a die for supporting the steel sheeting, the die having a die opening with a flared die face for facing the flaring surface of the flaring element such that the opening in the steel sheeting is flared by the flaring surface of the flaring element and the die face in the working stroke.

2. The punch and die assembly as claimed in claim 1, wherein the punching element has eight peaks and eight troughs.

3. The punch and die assembly as claimed in claim 1, wherein the working portion of the punching element has a diameter, at a working end, of 70 mm to 160 mm.

4. The punch and die assembly as claimed in claim 3, wherein the flaring element has a diameter of 90 mm to 200 mm.

5. The punch and die assembly as claimed in claim 3, wherein the die face has a minimum diameter of 80 mm to 180 mm.

6. The punch and die assembly as claimed in claim 5, wherein the die face has a maximum diameter of 90 mm to 200 mm.

7. The punch and die assembly as claimed in claim 1, wherein the die face has a maximum diameter that is 10 mm to 40 mm greater than a diameter of the working end of the punching element.

8. The punch and die assembly as claimed in claim 1, wherein a back angle defined by radial profiles of an outer surface and an inner surface of the working portion is between 42° and 48°.

9. The punch and die assembly as claimed in claim 1, wherein the height of the working portion, measured from the face of the base portion is between 9 mm and 12 mm.

10. The punch and die assembly as claimed in claim 1, wherein each peak defines an axial profile with a curve having an average radius of between 28 mm and 33 mm.

11. The punch and die assembly as claimed in claim 1, wherein each trough defines an axial profile with a curve having an average radius of between 5 mm and 15 mm.

12. The punch and die assembly as claimed in claim 1, wherein the flaring element has a base portion that can be fastened to a punch bolster and a flaring portion that extends from the base portion.

13. The punch and die assembly as claimed in claim 12, wherein the flaring surface has an axial profile with a radius of curvature of between 9 mm and 13 mm.

* * * * *